US009091983B2

(12) United States Patent
Matsui et al.

(10) Patent No.: US 9,091,983 B2
(45) Date of Patent: Jul. 28, 2015

(54) RECORDING MATERIAL DETECTING APPARATUS AND AN IMAGE-FORMING APPARATUS

(71) Applicant: CANON KABUSHIKI KAISHA, Tokyo (JP)

(72) Inventors: Norio Matsui, Mishima (JP); Tsutomu Ishida, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 52 days.

(21) Appl. No.: 13/951,784

(22) Filed: Jul. 26, 2013

(65) Prior Publication Data

US 2014/0037351 A1 Feb. 6, 2014

(30) Foreign Application Priority Data

Aug. 2, 2012 (JP) ..... 2012-172362

(51) Int. Cl.
*G03G 15/00* (2006.01)

(52) U.S. Cl.
CPC ..... *G03G 15/50* (2013.01); *G03G 15/5029* (2013.01); *G03G 2215/00616* (2013.01)

(58) Field of Classification Search
CPC ..... G03G 15/2029
USPC ..... 399/389
See application file for complete search history.

(56) References Cited

U.S. PATENT DOCUMENTS

| | | | |
|---|---|---|---|
| 6,853,393 | B2 | 2/2005 | Akita |
| 2010/0259772 | A1 | 10/2010 | Ebihara et al. |
| 2012/0148275 | A1 * | 6/2012 | Matsui et al. |

FOREIGN PATENT DOCUMENTS

| | | | |
|---|---|---|---|
| JP | 2004-38879 | A | 2/2004 |
| JP | 2010-266432 | A | 11/2010 |

* cited by examiner

*Primary Examiner* — Susan Lee
(74) *Attorney, Agent, or Firm* — Fitzpatrick, Cella, Harper & Scinto

(57) ABSTRACT

A recording material detecting apparatus includes a light guiding unit that allows first and second light to enter a surface of a recording material, respectively, in two directions which are not parallel; an imaging device that images a first light irradiated area and a second light irradiated area, on the surface of the recording material; and an output device that outputs information on a surface condition of the recording material based on an output of the imaging device. When viewed in a direction along the center optical axes of first and second light sources which are of the same type, the first and second light sources are arranged such that the respective reference lines of the rotational phases around the center optical axes are rotated in opposite directions by approximately the same angles from a line perpendicular to the direction where the first and second light sources are arrayed.

18 Claims, 39 Drawing Sheets

PRINTING IMAGE SIGNAL
10
11
11Bk
11M
11Y
31Bk
31C
31M
31Y
2Bk
2C
2M
2Y
8Bk
8C
8M
8Y
5Bk
5C
5M
5Y
1Bk
1C
1M
1Y
4Bk
4C
4M
4Y
13
28
29
23
24
26
25
21a
21ah
21b
21bh
21
20
16
15
19a
19b
P
50
18
17

FIG.33 TORSION ANGLE ON PAPER SURFACE $\gamma$°

| | ENTRY ANGLE $\theta$° | | | | | |
|---|---|---|---|---|---|---|
| $\alpha$° | 10 | 11 | 12 | 13 | 14 | 15 |
| 1 | 84.3 | 84.8 | 85.2 | 85.6 | 85.9 | 86.1 |
| 2 | 78.6 | 79.6 | 80.5 | 81.2 | 81.8 | 82.3 |
| 3 | 73.2 | 74.6 | 75.9 | 76.9 | 77.8 | 78.6 |
| 4 | 68.1 | 69.9 | 71.4 | 72.7 | 73.9 | 74.9 |
| 5 | 63.3 | 65.4 | 67.2 | 68.7 | 70.1 | 71.3 |
| 6 | 58.8 | 61.2 | 63.2 | 65.0 | 66.5 | 67.9 |
| 7 | 54.7 | 57.2 | 59.4 | 61.4 | 63.1 | 64.6 |
| 8 | 51.0 | 53.6 | 55.9 | 58.0 | 59.8 | 61.5 |
| 9 | **47.6** | 50.3 | 52.7 | 54.9 | 56.8 | 58.5 |
| 10 | **44.6** | **47.3** | **49.7** | 51.9 | 53.9 | 55.7 |
| 11 | **41.8** | **44.5** | **46.9** | **49.2** | 51.2 | 53.1 |
| 12 | 39.2 | **41.9** | **44.4** | **46.6** | **48.7** | 50.6 |
| 13 | 36.9 | 39.6 | **42.0** | **44.3** | **46.3** | **48.3** |
| 14 | 34.9 | 37.4 | 39.8 | **42.1** | **44.1** | **46.1** |
| 15 | 32.9 | 35.5 | 37.8 | **40.0** | **42.1** | **44.0** |

RECORDING MATERIAL DETECTING APPARATUS AND AN IMAGE-FORMING APPARATUS

BACKGROUND OF THE INVENTION

1. Field of the Invention

The present invention relates to a recording material detecting apparatus and an image-forming apparatus.

2. Description of the Related Art

In an image-forming apparatus, such as a copying machine and a laser printer, that forms an image on a recording material (recording paper) by transferring and fixing a developer image based on an electro-photographic system, it is preferable to set various image forming conditions according to the size and type (paper type) of the recording material. For example, it has been known that transfer conditions (e.g., transfer bias, conveying speed of recording material during transfer) and the fixing conditions (e.g., fixing temperature, conveying speed of recording material during fixing) are set according to the size and type of the recording material which have been set by the user via a control panel or the like.

A technique proposed lately is to identify a size and a type of recording material using a sensor that detects the recording material in the image-forming apparatus, and setting the transfer conditions or fixing conditions according to the identified result. Japanese Patent Application Laid-Open No. 2004-38879 discloses that the surface smoothness is determined by imaging the surface of the recording material using a CMOS sensor.

According to the technique of imaging the surface of the recording material using such an image sensor as a CMOS sensor, a shading generated due to the unevenness of the surface is directly captured. However in the case of identifying standard office paper, for example, the shading generated due to the unevenness of the surface is often different depending on the fiber orientation direction (machine orientation) when the paper is manufactured. In other words, if light is irradiated from a direction perpendicular to the fiber orientation direction of the paper, a high contrast image is acquired where the unevenness state on the surface is enhanced. If light is irradiated from a direction the same as the fiber orientation direction, shading due to the unevenness does not appear easily, and a low contrast image is acquired. In other words, the identification result changes in some cases even if the same paper is tested, depending on whether the paper is fed vertically or horizontally.

In Japanese Patent Application Laid-Open No. 2004-38879, identification accuracy is improved by irradiating light diagonally with respect to the paper conveying direction. However the fiber direction of paper does not always match with or is not always perpendicular to the conveying direction, and in some cases the surface condition of paper, of which fibers are oriented in the diagonal direction with respect to the conveying direction, is identified as the surface characteristic of the paper itself.

Therefore, in Japanese Patent Application Laid-Open No. 2010-266432, light is irradiated onto a recording material in two different directions which are not parallel when viewed in a normal line direction of the surface of the recording material, using two independent light sources, shading on the surface of the recording material irradiated with the light in each direction is imaged, and two types of acquired images are used so that influence of the fiber orientation direction, with respect to the conveying direction of the recording material, is reduced and identification accuracy is improved.

In the technique of Japanese Patent Application Laid-Open No. 2010-266432, however, the two light sources are used to irradiate light onto the recording material in two different directions which are not parallel when viewed in the normal line direction of the surface of the recording material. But in the case of using two light sources, the directivity of the illuminance distribution of each light source may not be symmetrical. If this is so, light is irradiated onto the surface of the recording material in two different directions and the light quantity distribution in two areas to be imaged becomes asymmetrical, whereby an error may be generated when the image identification processing is performed.

SUMMARY OF THE INVENTION

It is an object of the present invention to provide a recording material detecting apparatus and an image-forming apparatus that can improve accuracy of identifying the surface condition of the recording material.

It is another object to provide a following recording material detecting apparatus.

A recording material detecting apparatus, comprising:

a first light source that emits first light;

a second light source that emits second light;

a light guiding unit that allows the first light and the second light to enter a surface of a recording material respectively in two directions which are not parallel when viewed in a normal line direction of a surface of the recording material;

an imaging device that images an area where the first light is irradiated and an area where the second light is irradiated, on the surface of the recording material; and an output device that outputs information on a surface condition of the recording material based on an output of the imaging device, wherein the second light source is a light source of which type is the same as that of the first light source, wherein when viewed in a direction along center optical axes of the first light source and the second light source, the first light source and the second light source are arranged such that respective reference lines of rotational phases around the center optical axes are rotated in opposite directions by approximately the same angles from a line perpendicular to a direction where the first light source and the second light source are arrayed.

It is another object to provide a following recording material detecting apparatus.

A recording material detecting apparatus, comprising:

a first light source that emits first light;

a second light source that emits second light;

a light guiding unit that allows the first light and the second light to enter a surface of a recording material respectively in two directions which are not parallel when viewed in a normal line direction of a surface of the recording material;

an imaging device that images a long imaging area including an area where the first light is irradiated and an area where the second light is irradiated, on the surface of the recording material; and an output device that outputs information on a surface condition of the recording material based on an output of the imaging device, wherein an area irradiated with the first light of which light quantity is a predetermined value or more and an area irradiated with the second light of which light quantity is a predetermined value or more are approximately ellipses, respectively, wherein the first light source and the second light source are arranged so that major axes of the ellipses match a long side direction of the imaging area.

It is another object to provide a following image-forming apparatus.

An image-forming apparatus, comprising:

a first light source that emits first light;

a second light source that emits second light;

a light guiding unit that allows the first light and the second light to enter a surface of a recording material, respectively, in two directions which are not parallel when viewed in a normal line direction of a surface of the recording material;

an imaging device that images an area where the first light is irradiated and an area where the second light is irradiated, on the surface of the recording material;

an output device that outputs information on a surface condition of the recording material based on an output of the imaging device;

an image-forming unit that forms an image on the recording material; and a control unit that sets imaging-forming conditions used by the image-forming unit, according to an output of the output device, wherein the second light source is a light source of which type is the same as that of the first light source, wherein when viewed in a direction along center optical axes of the first light source and the second light source, the first light source and the second light source are arranged such that respective reference lines of rotational phases around the center optical axes are rotated in opposite directions by approximately the same angles from a line perpendicular to a direction where the first light source and the second light source are arrayed.

It is another object to provide a following-image forming apparatus.

An image-forming apparatus, comprising:

a first light source that emits first light;

a second light source that emits second light;

a light guiding unit that allows the first light and the second light to enter a surface of a recording material respectively in two directions which are not parallel when viewed in a normal line direction of a surface of the recording material;

an imaging device that images an area where the first light is irradiated and an area where the second light is irradiated, on the surface of the recording material;

an output device that outputs information on a surface condition of the recording material based on an output of the imaging device;

an image-forming unit that forms an image on the recording material; and a control unit that sets imaging-forming conditions used by the image-forming unit, according to an output of the output device, wherein an area irradiated with the first light of which light quantity is a predetermined value or more and an area irradiated with the second light of which light quantity is a predetermined value or more are approximately ellipses, respectively, wherein the first light source and the second light source are arranged so that major axes of the ellipses match a long side direction of the imaging area.

Further features of the present invention will become apparent from the following description of exemplary embodiments (with reference to the attached drawings).

BRIEF DESCRIPTION OF THE DRAWINGS

FIG. 33 is a table comparing screw angles;

DESCRIPTION OF THE EMBODIMENTS

Embodiments of the present invention will now be described with reference to the drawings. The dimensions, materials and shapes of the composing elements disclosed in the embodiments and relative positions thereof can be appropriately modified depending on the configuration of the apparatus to which the present invention is applied, and on various conditions. In other words, the scope of the present invention is not limited to the embodiments described below.

Embodiment 1

<General Configuration of Image-Forming Apparatus>

Figure 1:
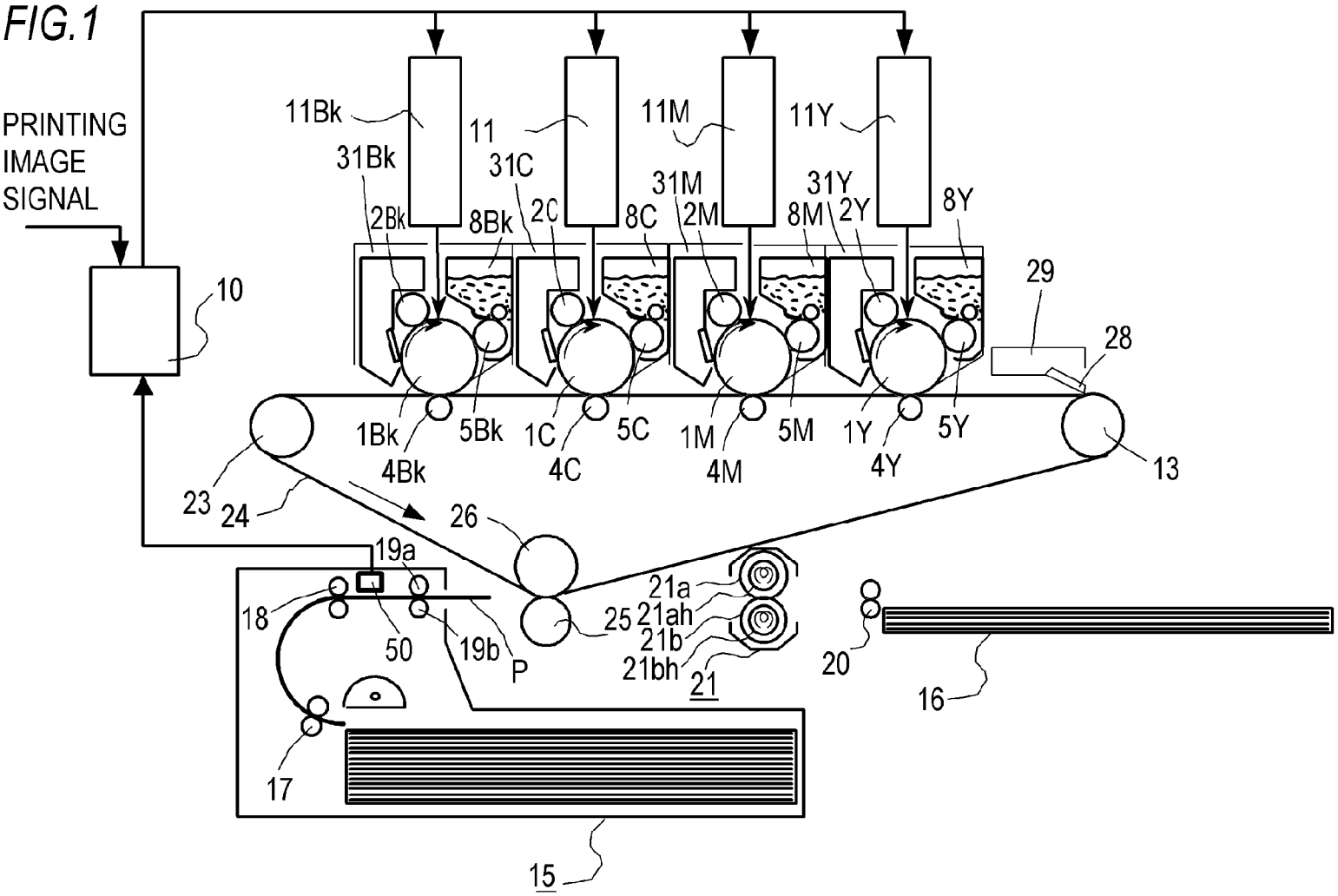
FIG. 1 is a diagram depicting an image-forming apparatus according to an embodiment of the present invention.

FIG. 1 is a schematic cross-sectional view depicting a configuration of an image-forming apparatus according to an embodiment of the present invention. A recording material detecting apparatus according to an embodiment of the present invention can be used for a color image-forming apparatus of an electro-photographic system, for example, and FIG. 1 is a diagram depicting a configuration of such an example, that is a tandem type color image-forming apparatus using an intermediate transfer belt. The configuration of the image-forming apparatus to which the present invention is applied, however, is not limited to this configuration.

An image-forming unit of the image-forming apparatus according to this embodiment has four image-forming stations which correspond to each color of yellow (Y), magenta (M), cyan (C) and black (Bk), respectively. In FIG. 1, one of Y, M, C and Bk is attached to a reference numeral of each composing element in order to indicate which one of the colors Y, M, C and Bk the composing element corresponds to. In the following description, however, Y, M, C and Bk are omitted unless a distinction is required.

Each image-forming station has a photoreceptor (photosensitive drum) 1, a charged roller (primary charging unit) 2, an exposure optical scanner unit 11, a developing device (developing unit) 8, and a primary transfer roller 4. The image-forming apparatus also has a paper feed cassette (paper feed unit) 15, an intermediate transfer belt 24, a driver roller 23 that drives the intermediate transfer belt 24, a stretch roller 13, a secondary transfer counter roller 26, a secondary transfer roller 25, a fixing unit 21, and a control unit 10 that controls operation of each composing element. The photosensitive drum 1 is configured by coating an organic photoconductive layer on the outer periphery of an aluminum cylinder, and is rotated by the diving force transferred from a driving motor (not illustrated). The driving motor rotates the photosensitive drum 1 clockwise as shown in FIG. 1 according to the image-forming operation.

When the control unit 10 receives an image signal, a recording material P is fed from the paper feed cassette 15 or the like into the image-forming apparatus by paper feed rollers 17 and 18. Then the recording material P is held between roller type synchronous rotators, that is, a convey (registration) roller 19*a* and a convey (registration) counter-roller 19*b*, to synchronize the later mentioned image forming operation and the conveying operation of the recording material P, then stops and stands by.

The control unit 10, on the other hand, forms an electrostatic latent image on the surface of the photosensitive drum 1, which is charged by the function of the charged roller 2 to have a predetermined potential, by the exposure optical scanner unit 11. The developing device 8 is a unit to visualize an electrostatic latent image, and develops yellow (Y), magenta (M), cyan (C) and black (Bk) for each station. A sleeve 5 is disposed in each developing device 8, and the developing bias is applied to visualize the electrostatic latent image. In this way, the electrostatic latent image formed on the surface of each photosensitive drum 1 is developed as a single color toner image (single color developer image) by the function of each developing device 8. In each station, the photoreceptor 1, the charged roller 2 and the developing device 8 are integrated in the form of a toner cartridge 31, which is removably installed in the image-forming apparatus main unit.

The intermediate transfer belt 24 contacts each photosensitive drum 1, and rotates synchronizing with the rotation of the photosensitive drum 1 in the counterclockwise direction when a color image is formed. The developed single color toner image is sequentially transferred by the function of the primary transfer bias that is applied to the primary transfer roller 4, and forms a multicolor toner image on the intermediate transfer belt 24. Then the multicolor toner image formed on the intermediate transfer belt 24 is conveyed to a secondary transfer nip unit, which is constituted by the intermediate transfer belt 24, the secondary transfer roller 25 and the secondary transfer counter-roller 26. At the same time, the recording material P, which has been waiting in a state of being held between the convey roller pair 19*a* and 19*b*, is transferred to the secondary transfer nip unit, while synchronizing with the multicolor toner image on the intermediate transfer belt using the function of the convey roller pair 19*a* and 19*b*. Then in the secondary transfer nip unit, the multicolor toner image on the intermediate transfer belt 24 is transferred to the recording material P by a function of the secondary transfer bias that is applied to the secondary transfer roller 25.

The fixing unit 21 is for melting and fixing the transferred multicolor toner image while conveying the recording material P, and has a fixing roller 21*a* for heating the recording material P and a pressure roller 21*b* for contacting the recording material P to the fixing roller 21*a* by pressure, as shown in FIG. 1. The fixing roller 21*a* and the pressure roller 21*b* are hollow inside, where heaters 21*ah* and 21*bh* are embedded, respectively. The recording material P holding the multicolor toner image is conveyed by the fixing roller 21*a* and the pressure roller 21*b*, while receiving heat and pressure, whereby toner is fixed on the surface of the recording material. After the toner image is fixed, the recording material P is discharged to the paper output tray 16 by the discharge roller 20, and the image forming operation ends. A cleaning unit 28 is for cleaning toner that remains untransferred on the intermediate transfer belt 24, and the untransferred toner collected here is stored in a cleaner container 29 as waste toner.

This series of image forming operations is controlled by the controller 10 installed to the image-forming apparatus.

In the image-forming apparatus in FIG. 1, the recording material detecting apparatus 50 according to this embodiment is installed in a recording material detection unit in front of the convey roller pair 19*a* and 19*b*, and can detect information reflecting the surface smoothness (surface condition) of the recording material P conveyed from the paper feed cassette 15. In this embodiment, identification by the recording material detecting apparatus 50 is performed while the recording material P is fed into the image-forming apparatus from the paper feed cassette 15, held by the convey (registration) roller pair 19*a* and 19*b*, and stops. Based on the detection information (identification result) of the surface condition of the recording material transferred from the recording material detecting apparatus 50, the control unit 10 sets image-forming conditions, such as transfer and fixing conditions including optimum transfer bias and fixing temperature, and controls the operation of the image-forming apparatus.

Figure 2A:
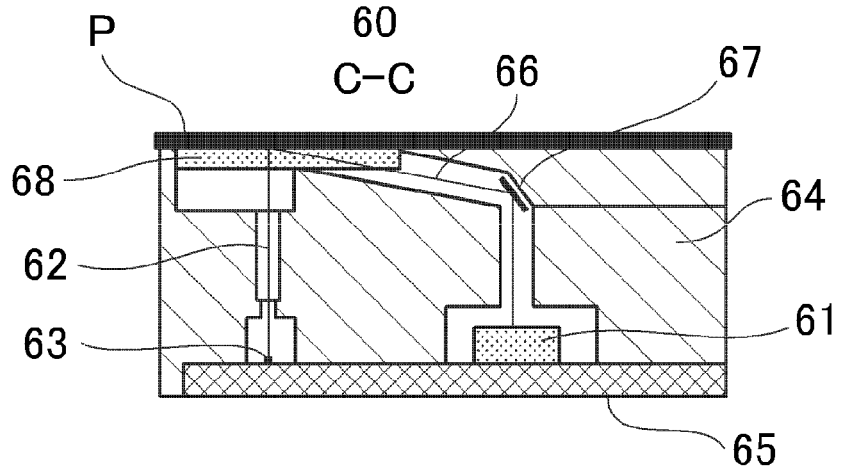
FIGS. 2A and 2B are diagrams depicting a configuration of a recording material detecting apparatus according to Embodiment 1 of the present invention.
Figure 2B:
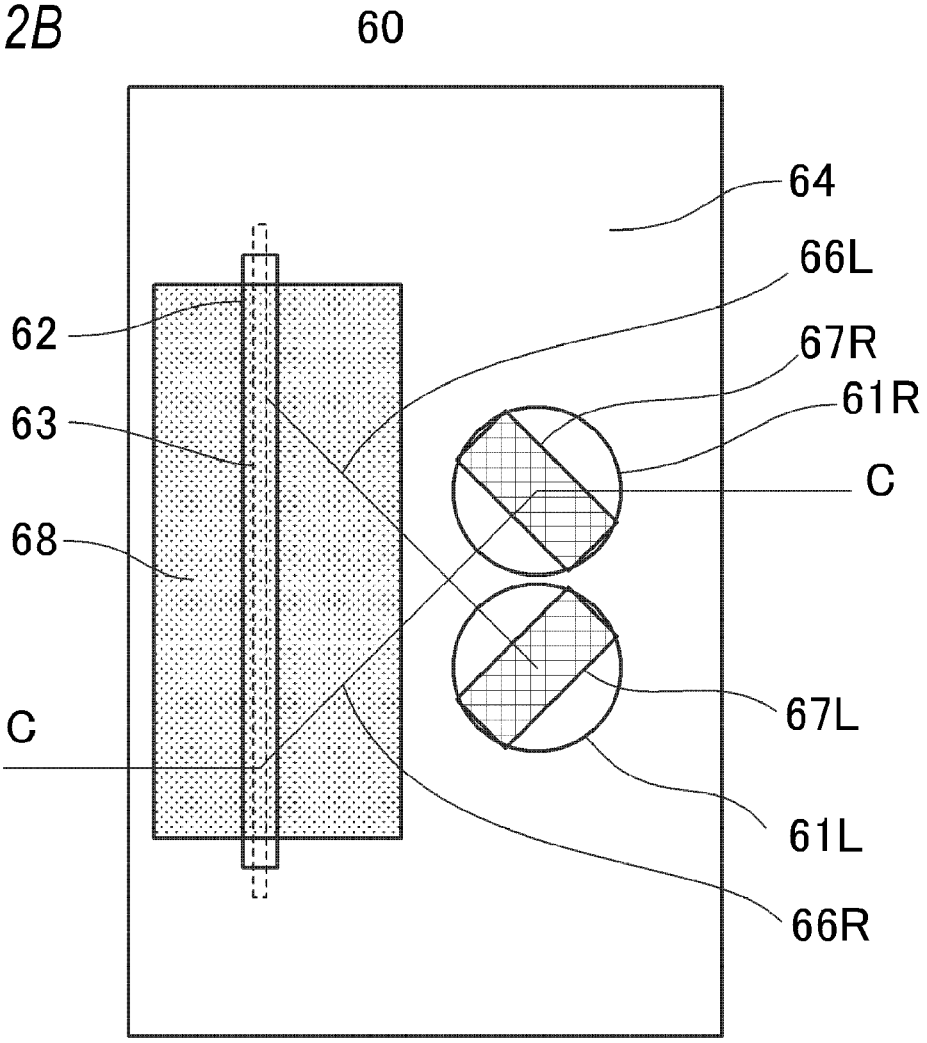

FIGS. 2A and 2B are schematic diagrams depicting a configuration of the recording material detecting apparatus according to Embodiment 1 of the present invention, where FIG. 2A is a cross-sectional view at the C-C line in FIG. 2B, and FIG. 2B is a top view of the recording material detecting apparatus 60 (diagram viewing the surface of the recording material P in the normal line direction), where a part of a top cover is transparent to clearly show the positions of the light sources and other components. Identical composing elements disposed symmetrically are denoted with a reference numeral with an R or L.

The recording material detecting apparatus 60 uses chip mounted type LEDs 61 installed on the substrate 65 in the detecting apparatus main unit 64 as the light sources (first light source, second light source), from which light (first light, second light) is irradiated onto the recording material P via the optical path 66. The optical paths 66L and 66R correspond to the center rays of the light emitted from the LED 61L and the LED 61R, and are irradiated onto the surface of the recording material P, respectively. In this case, the light emitted from the LED 61 is deflected in the apparatus by a reflection unit (light-guiding unit) 67, transmits through an optically transparent cover member (cover glass) 68, and is guided to the recording material P. Then the surface of the recording material P is irradiated with light, whereby the surface condition of the recording material P can be observed. Then the surface condition of the recording material P is imaged, via a light collecting element (rod lens) 62, by a CMOS image sensor (line sensor) 63 in which a plurality of photoelectric conversion elements are arrayed in one direction on the substrate 65, and then a computing unit 69 (output device) extracts and calculates a lightness correspondence value (optical feature value) from the surface condition observation image (output from the image sensor 63), and outputs the information on the surface condition of the recording material P. The surface condition of the recording material P can be determined based on the outputted information.

As FIG. 2B shows, the light emitted from the light sources 61R and 61L enters the recording material P from two directions which are not parallel when viewed in the normal line direction of the surface of the recording material P (not parallel with the normal line direction), such as the optical paths 66R and 66L, so that the surface condition of the recording material can be identified regardless the fiber orientation direction. Here the reflection unit 67 may be a reflection film formed on a plate made of glass or acrylic, or may be a sheet material having high reflectance, such as Metalumy®, which is aluminum deposited on a PET base material, manufactured by Toray Industries, Inc., adhered using a double sided tape or the like. The reflection unit may also be formed by forming a protruding portion on a part of the housing, and depositing a reflection surface thereon.

Figure 3A:
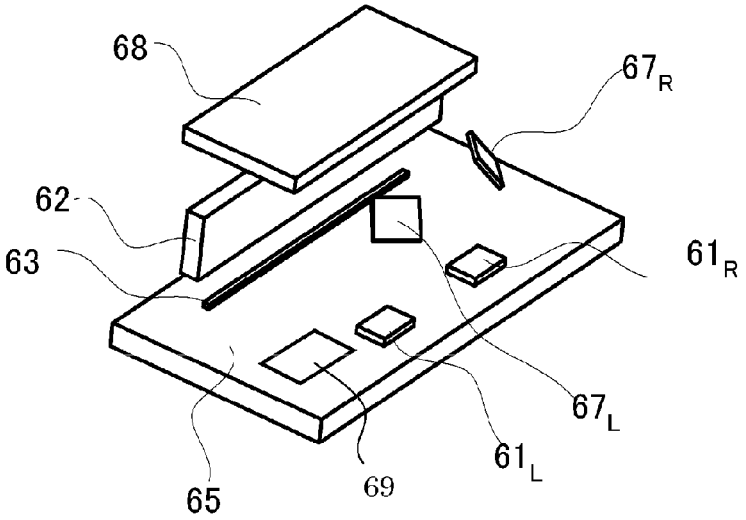
FIGS. 3A and 3B are diagrams depicting a configuration of a recording material detecting apparatus according to Embodiment 1 of the present invention.
Figure 3B:
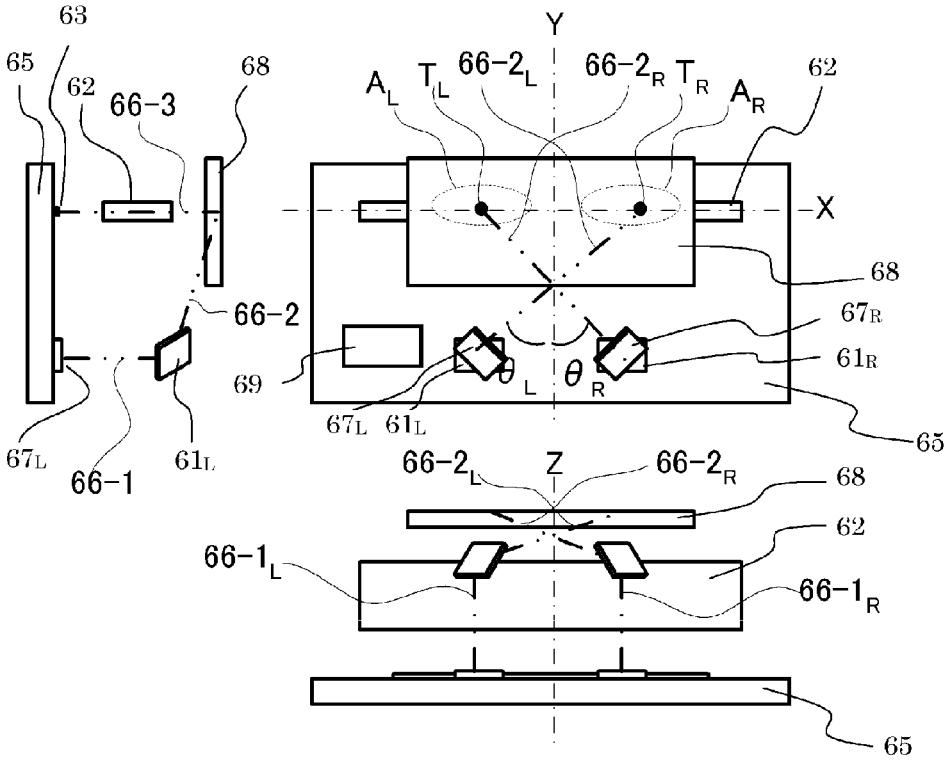

The configuration of the recording material detecting apparatus will be described in more detail with reference to FIGS. 3A and 3B. FIGS. 3A and 3B are schematic diagrams depicting the configuration of the recording material detecting apparatus, where FIG. 3A shows a three-dimensional arrangement configuration of the LED light source 61, the reflection unit 67 and other components, excluding the housing unit, and FIG. 3B shows a three-view drawing of a state including the optical path. Identical components disposed symmetrically are denoted with a reference numeral with an R or L.

In FIG. 3B, a bold two-dot chain line 66-1 indicates a virtual center line of the optical path of the light which is emitted from the light source 61 and enters the reflection unit 67 (optical axis of the beam emitted by the light source 61). A bold two-dot chain line 66-2 indicates a virtual center line of the optical path of the light which is reflected by the reflection unit 67 (rear face in FIG. 3B), transmits through the cover member 68, and propagates to a target T which is on the recording material P. In FIG. 3B, each ellipse A indicated by a broken line is an irradiation range when the light propagating to the above mentioned optical path is irradiated onto an area around the recording material (cover member) with the target T as an optical center. Each optical axis is inclined by θ from the axis that passes through the center of a virtual segment connecting the light sources 61L and 61R, and extends in the recording material convey direction when the light is projected in a direction perpendicular to the irradiation surface. The line 66-3 indicates a virtual optical path of light that passes through the target T and enters the image sensor 63 when the image sensor 63 linearly scans the recording material surface portion A including the target T via the light collecting element 62. In FIG. 3B, the arrangement reference coordinates of each component are indicated by the X, Y and Z axes. The Y axis indicates an optical symmetric axis and the recording material convey direction, and the X axis on the image sensor 63 indicates the direction perpendicular to the recording material convey direction. The Z axis indicates the thickness direction of the recording material.

Figure 4:
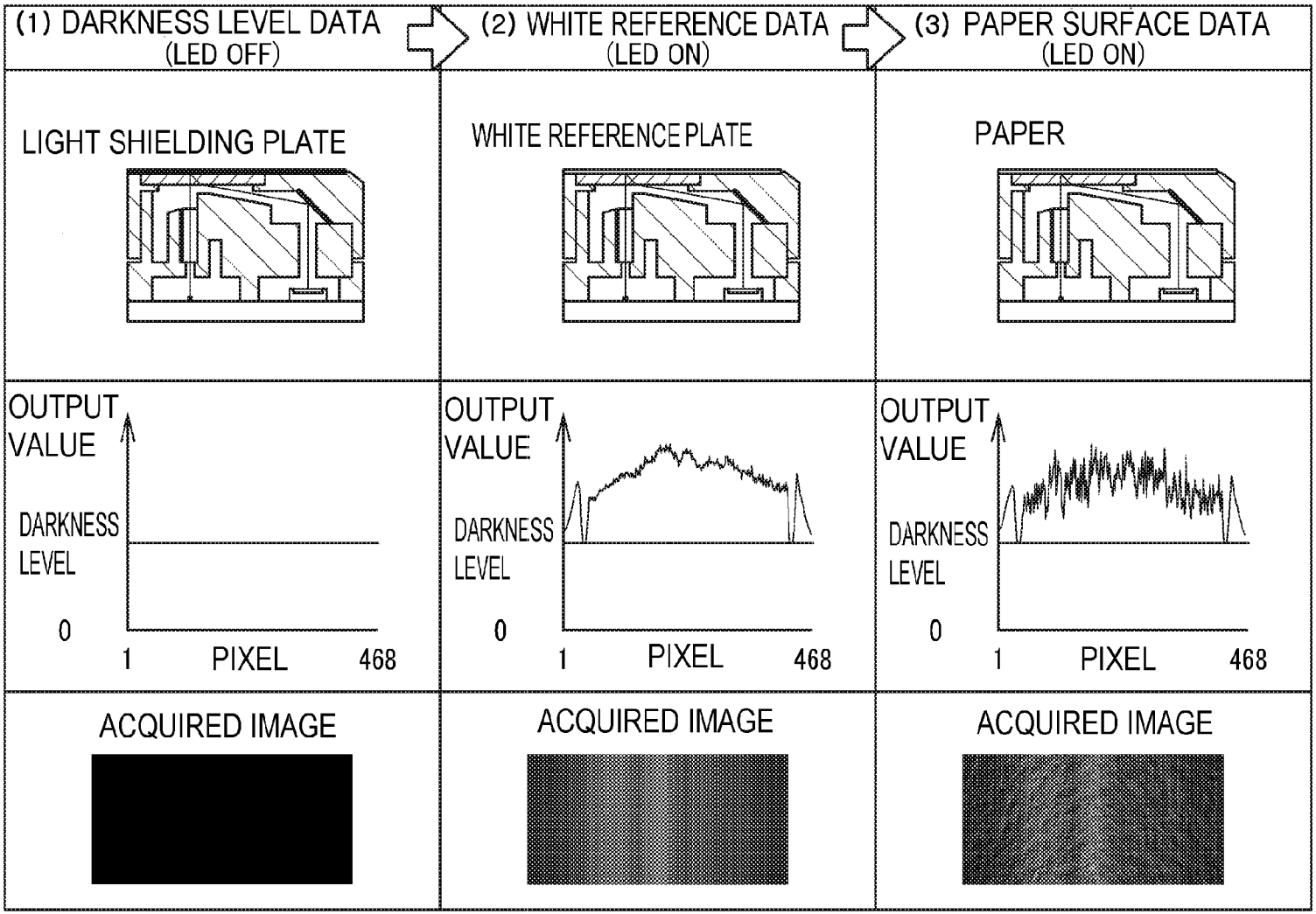
FIG. 4 is a diagram depicting a method of acquiring a recording material surface condition.

FIG. 4 is a diagram depicting a method for acquiring the recording material surface condition in the above mentioned configuration. As FIG. 4(1) shows, first a light shielding plate is placed on the cover member (cover glass) 68 in a state of not illuminating the LEDs 61 (in the OFF state), and the output of the image sensor is received in a state where no light from the outside enters. The output value of the image sensor at this time is regarded as the "darkness level". An image acquired at this time is shown in the lower portion of FIG. 4(1). Then as FIG. 4(2) shows, a white reference plate is provided to specify the reflected light quantity to be a reference, and the white reference plate is placed on the cover member 68 in the same manner as placing the light shielding plate. In this state, the LEDs 61 are illuminated (in the ON state), and the output of the image sensor at this time is acquired. The output acquired here is the light intensity distribution of the illuminated left and right LEDs 61, when light is reflected by the white reference plate having a uniform reflection characteristic and received on the image sensor. An image acquired at this time is shown in the lower portion of FIG. 4(2).

Now the emission state by the LEDs 61 will be described in detail with reference to FIG. 5A to FIG. 7B. FIG. 5A to FIG. 7B are diagrams depicting the light quantity intensity distribution of each reflected light image.

<Light Quantity Intensity Distribution of First Reflected Light Image>

Figure 5A:
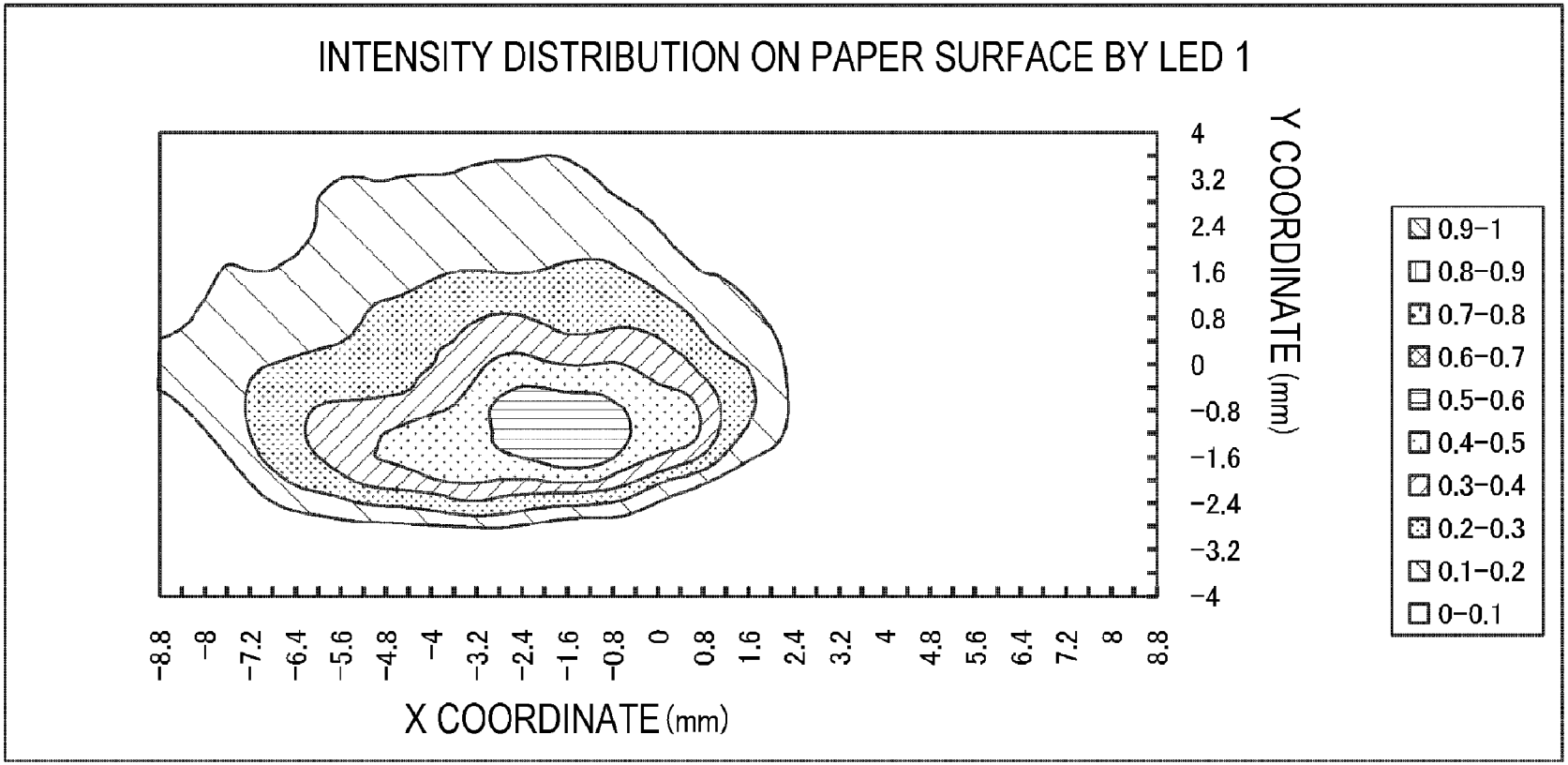
FIGS. 5A and 5B are diagrams depicting an intensity distribution of the light quantity of an LED on one side.
Figure 5B:
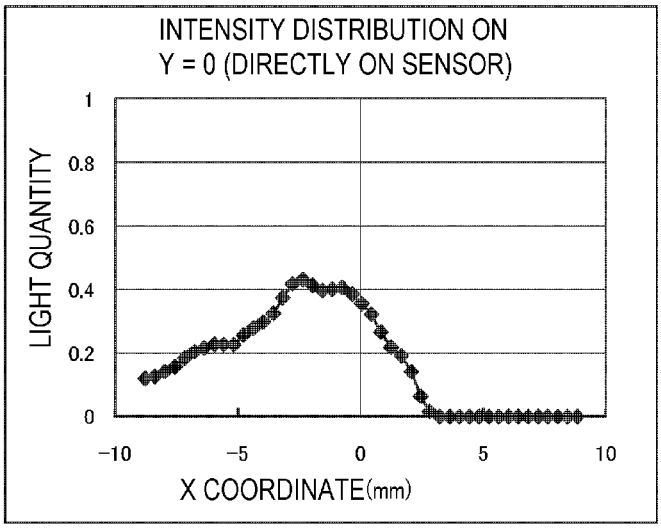

FIG. 5A shows an example of the intensity distribution of light which is illuminated by the right side LED 1 (LED 61R) in a crossing direction to the upper left on the cover glass 68 (viewed in the Z axis direction in FIG. 3). FIG. 5B shows a light quantity value at the image sensor scanning position on the Y coordinate 0, which is the ordinate.

<Light Quantity Intensity Distribution of Second Reflected Light Image>

Figure 6A:
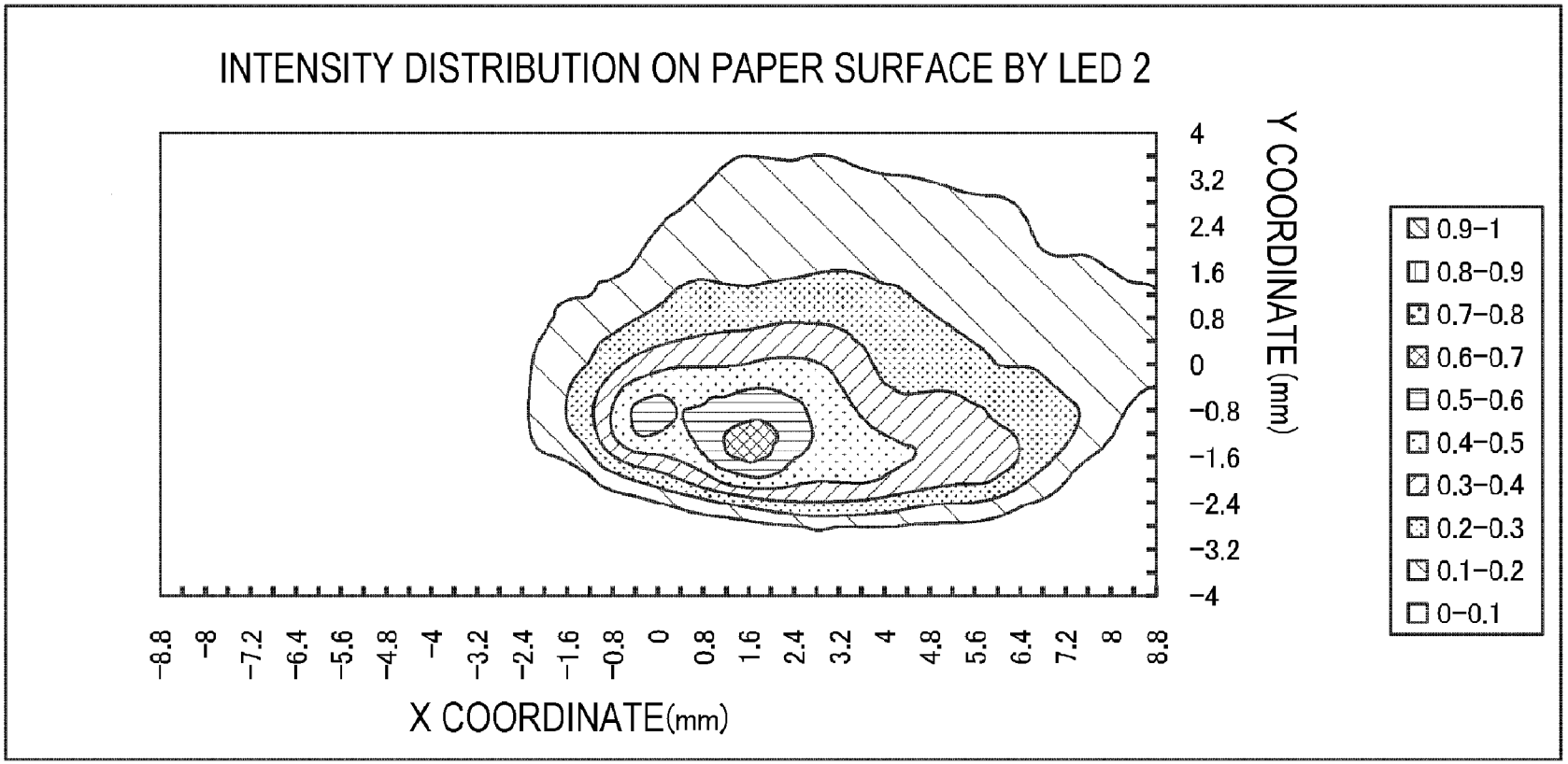
FIGS. 6A and 6B are diagrams depicting an intensity distribution of the light quantity of an LED on the other side.
Figure 6B:
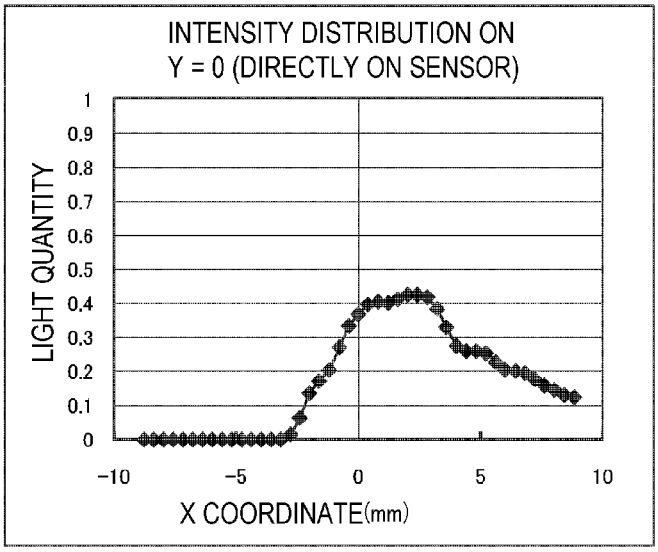

FIG. 6A shows an example of the intensity distribution of light on the right side on the cover glass 68 illuminated by the left side LED 2 (LED 61L). FIG. 6B shows a light quantity value at the image sensor scanning position on the Y coordinate 0.

<Light Quantity Intensity Distribution of Composite Reflected Light Image>

Figure 7A:
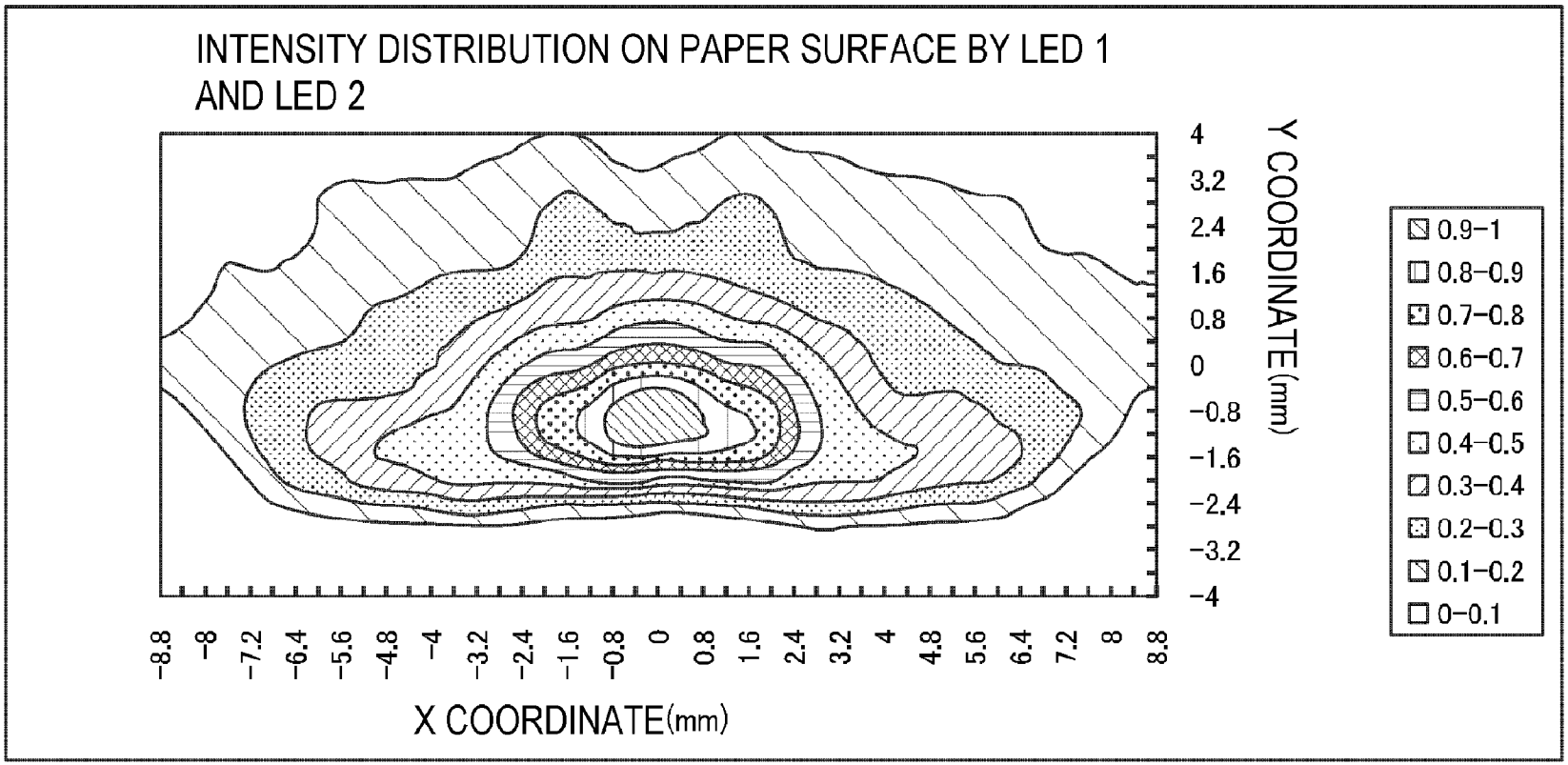
FIGS. 7A and 7B are diagrams depicting an intensity distribution of the light quantity of LEDs on both sides.
Figure 7B:
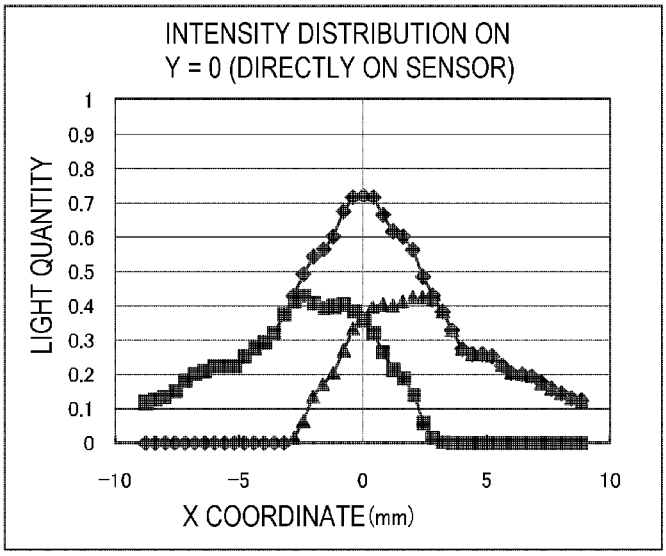

In actual operation, LEDs on both sides are illuminated simultaneously; therefore, the light intensity distribution shown in FIG. 7A is formed on the cover glass, and FIG. 7B shows the light intensity output value at Y=0, which is the image sensor scanning position (emission distribution by each LED is also shown).

Figure 8:
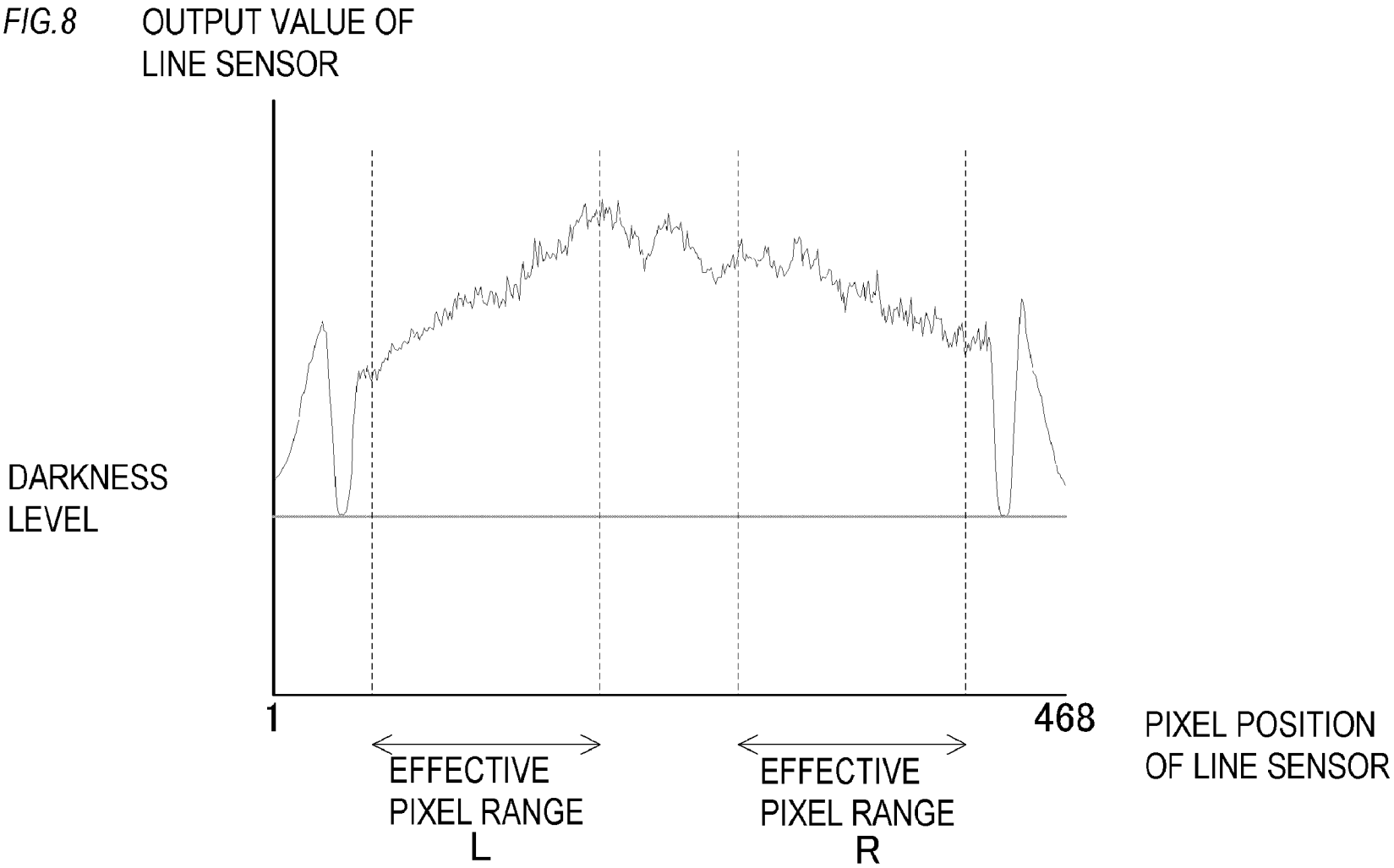
FIG. 8 is a diagram depicting an output of an image sensor.

FIG. 8 shows the output example of the imaging unit (image sensor 63). In this case, FIG. 8 is a graph showing the result when the imaging unit converted the captured composite reflected light image into an electric signal, and outputted the electric signal. The ordinate indicates the output value of the image sensor, and the abscissa indicates a pixel position on the image sensor. The recording material detecting apparatus 50 detects the light quantity outputted from the left and right LEDs in the present left and right image sensor effective pixel range L and R, respectively, and acquires linear image information. Further the recording material detecting apparatus 50 acquires a planar image by combining a plurality of continuous linear image information generated when the recording material is conveyed. Then the computing unit 69 of the recording material detecting apparatus 50 determines a contrast ratio corresponding to the surface condition (unevenness of fibers of the recording material) in each output by the left and right image sensor (peak value of the small jagged components on the image sensor output line). Then the computing unit 69 outputs a value on the surface condition of the recording material based on the mean value of the contrast ratios outputted by the left and right image sensors. Based on the output from the computing unit 69 of the recording material detecting apparatus 50, the control unit 10 sets the image forming conditions (e.g., transfer and fixing conditions, such as optimum transfer bias and fixing temperature) corresponding to a recording material of which surface condition is rougher as the mean value of the detected contrast ratios is greater, and controls the operation of the image-forming apparatus. By outputting the image based on the mean value of the contrast ratios of the outputs of the left and right image sensors, acquired by irradiating lights from two directions like this, information on the surface condition of the recording material can be outputted, which is less influenced by the fiber orientation direction of the recording material.

As the effective pixel ranges L and R show, the output of the image sensor has a general tendency to be high at the center, and gradually decreasing toward the left or right, respectively. The reason why the output of the image sensor decreases toward the left in the left effective pixel range L and decreases toward the right in the right effective pixel range R is because the distance from the light source to the image sensor scanning unit increases; therefore, the intensity (illuminance) of the light irradiated onto the surface of the recording material decreases (becomes darker). Even if the surface condition of the recording material is the same, the light intensifies in the contrast ratio with respect to the surface condition (unevenness of the fibers) of the recording material changes if the intensity of the light to be irradiated changes. Therefore, the general inclining amount of the above mentioned output can be corrected by the following method, but correcting the light quantity fluctuation values, to be the contrast ratio corresponding to the surface condition of the recording material, is difficult. Hence, if the inclining amount of the light quantity output is about the same in the left and right effective pixel ranges, then a contrast ratio detected under approximately the same conditions in the left and right effective pixel ranges can be acquired, and the surface condition of the recording material can be determined more accurately.

Now description on the method for acquiring information on the surface condition of the recording material in FIG. 4 continues. In FIG. 4(3), the paper, which is the recording material, is placed on the cover glass 68, the LEDs 61 are illuminated, and output of the image sensor is acquired. Thereby the output of the image sensor combining the emission distribution of the LEDs 61 and the surface condition of the recording material can be acquired. The recording material image acquired at this time is shown in the lower portion of FIG. 4(3).

Figure 9:
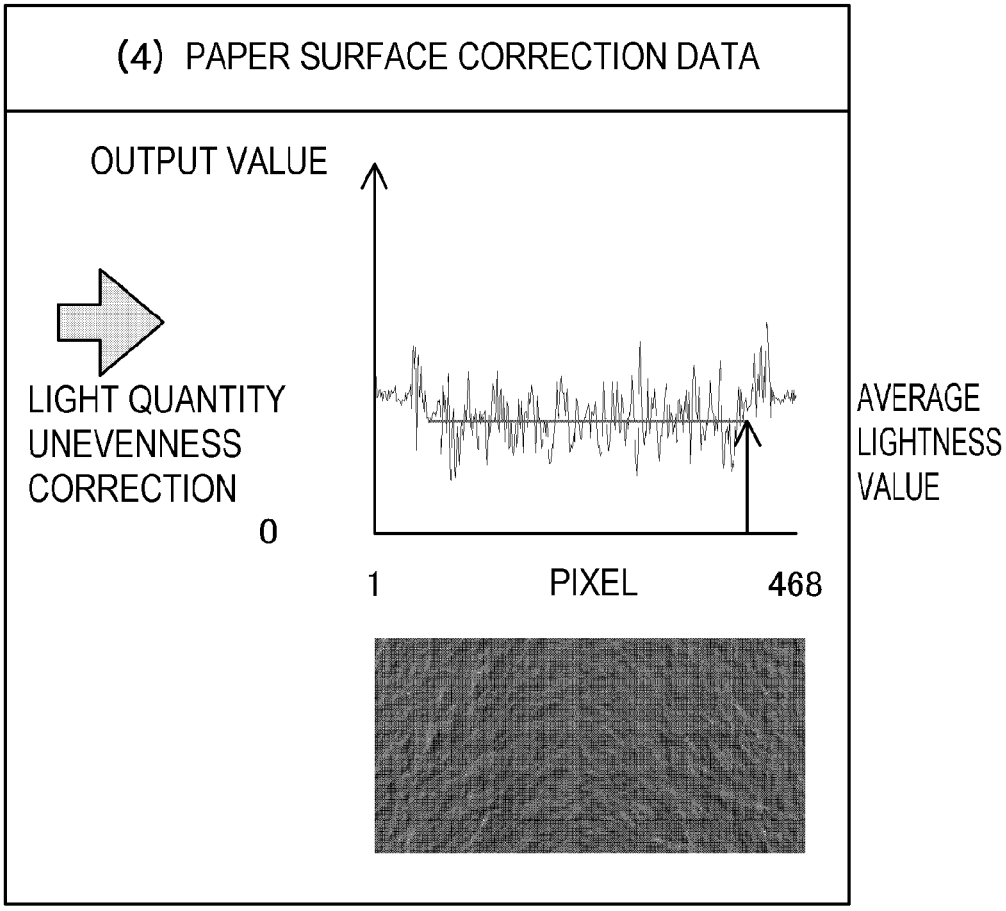
FIG. 9 is a diagram depicting surface condition data.

Then the following operation is performed using the output data acquired in FIG. 4(1) to FIG. 4(3). After normalizing each data with the darkness level reference value in FIG. 4(1), the white reference data acquired in FIG. 4(2) is subtracted from the data acquired in FIG. 4(3), to correct the light quantity inclination amount and the light quantity unevenness of the LEDs is acquired, and the surface condition data of the recording paper, which is not influenced by the emission distribution characteristics of the LEDs. FIG. 9 shows the result of this operation. The surface condition of the recording material can be estimated based on the lightness information of the output value of the image sensor that reflects the surface condition of the recording material.

Figure 10:
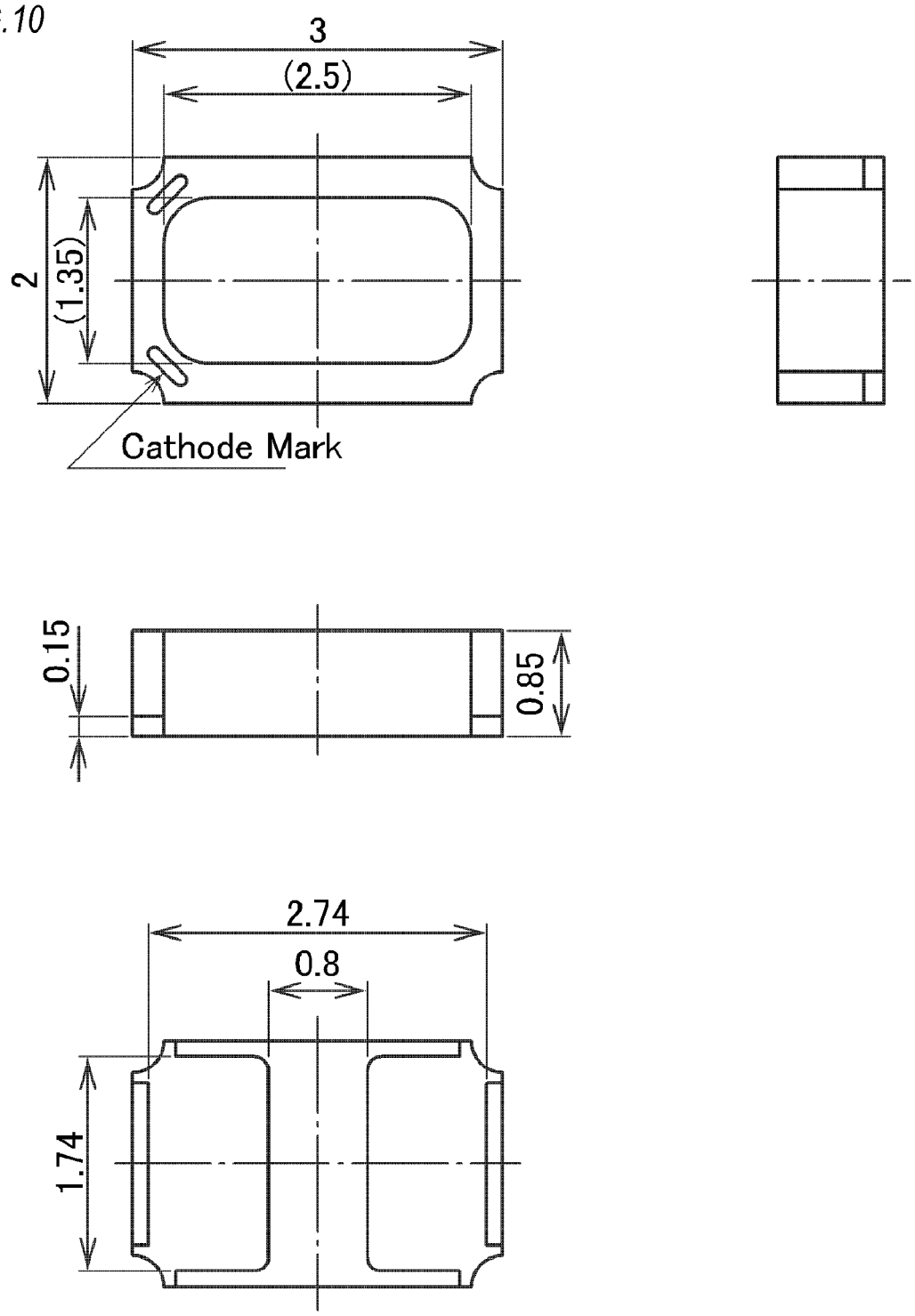
FIG. 10 comprises diagrams depicting a configuration of an LED.

FIG. 10 is an example of a concrete configuration of the light source, referring to an outside view excerpted from a specification of a white chip type LED NS2W150 made by Nichia Corporation, which is a surface mount type LED. FIG. 10 shows a four-view drawing of the outer shape and dimensions of each portion.

Figure 11:
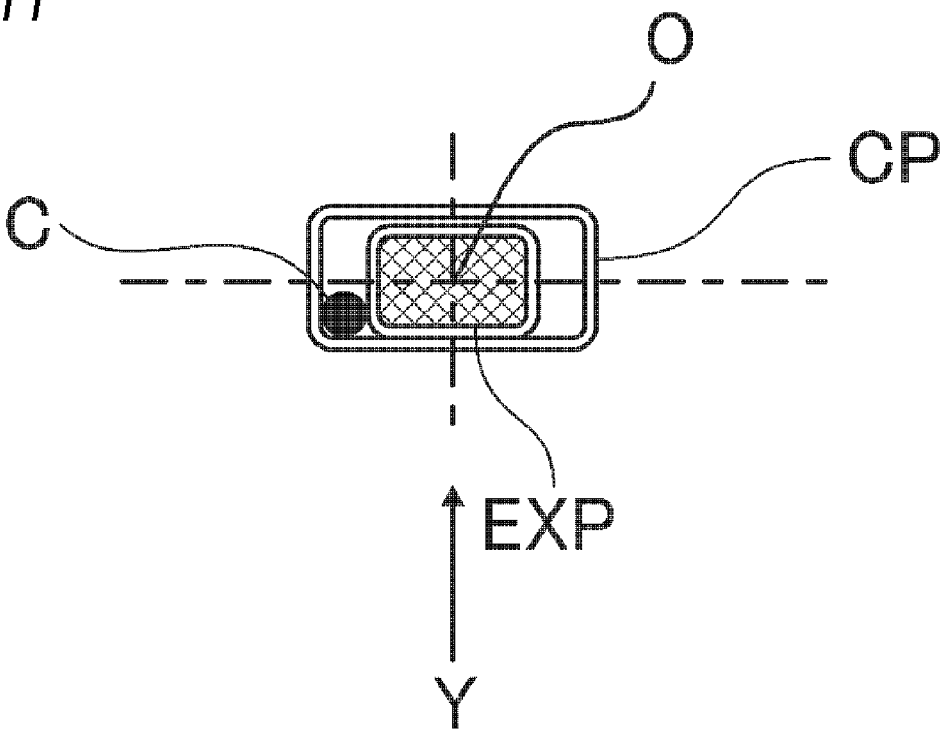
FIG. 11 is a diagram depicting a general configuration of an LED.

FIG. 11 shows a simplified version of the outside view of the chip type LED. Generally, a chip type LED is covered by a ceramic package material CP as shown in FIG. 11, the LED has an emission surface EXP which emits light by phosphor on the surface, and a cathode mark C indicates a cathode electrode portion formed on one corner on the surface. The power supply portion is disposed on the opposite side of the cathode electrode portion. The center of the emission surface EXP is the emission center O.

Figure 12A:
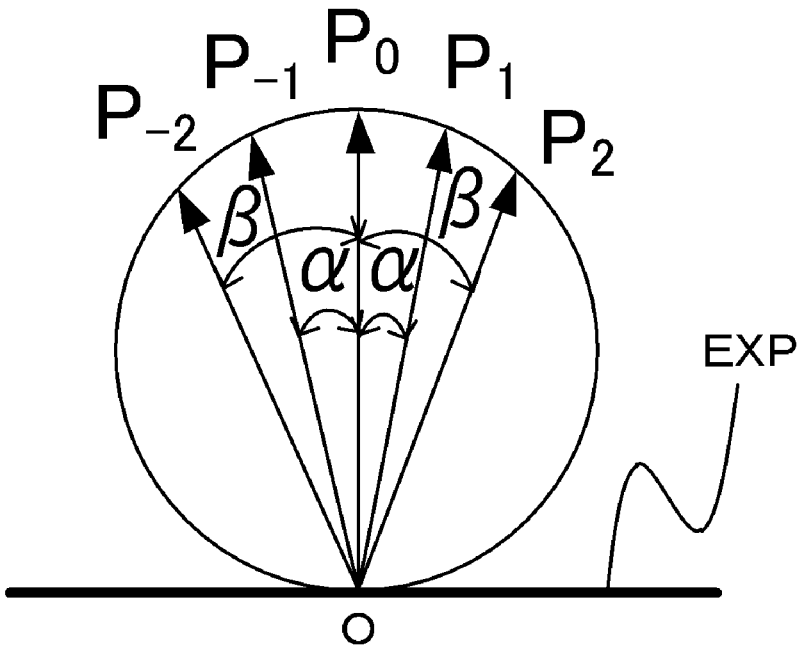
FIGS. 12A and 12B are vector diagrams depicting LED light irradiation distribution.
Figure 12B:
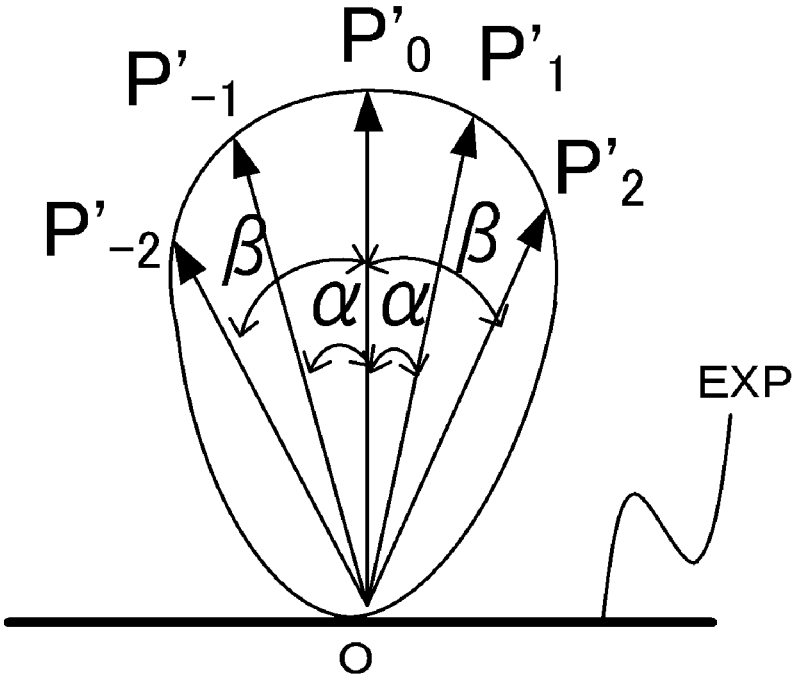

The directivity of the chip type LED will now be described. FIG. 12A and FIG. 12B show the directivity of the LED using vector diagrams from the emission center O of the LED, indicating the distribution of the relative illuminance in predetermined radiation angles based on the illuminance of the center optical axis in the normal line direction of the emission surface EXP. In FIG. 12A and FIG. 12B, the relative illuminance when the LED is viewed in the Y direction in FIG. 11 is shown. The center optical axis is the optical axis in the normal line direction of the emission surface EXP from the emission center O of the LED. In FIG. 12A, a typical intensity vector (magnitude, direction) from the emission point (start point of the arrow) is denoted with a reference symbol, such as P0 and P1. Let P0 be an illuminance vector in the normal line direction (radiation angle is 0°) of the emission surface EXP. $\alpha°$ and $\beta°$ are absolute values of the radiation angles based on the normal line direction of the emission surface EXP, and P1, P-1, P2 and P-2 denote relative illuminance based on P0 at radiation angles $\alpha°$ and $\beta°$ FIG. 12A shows an ideal state in which the vector distribution of the directivity is virtually a circle, where P1 and P-1, which are located in symmetrical positions at angle α° from P0 at angle 0°, have the same magnitude (length), and the direction (angles) of P1 and P-1 are line-symmetrical with respect to P0. P2 and P-2, which are outside P1 and P-1 by angle β°, also have a same magnitude (length). Here the line-symmetrical illumination distribution state with respect to the normal line (center optical axis) of the emission surface EXP refers to the "symmetrical" emission characteristic.

In the directivity distribution characteristic in FIG. 12B, on the other hand, the magnitude (length) of P1' and that of the corresponding P-1' located at positions at angle α° from the 0° axis, are different, and the magnitude P2' and that of the corresponding P-2', located in positions at angle β° from the 0° axis, are also different. In other words, the end points of the vector arrows are not symmetrical with respect to the normal line of the emission surface EXP. When the directivity of the illuminance distribution, viewed in a direction perpendicular to the normal line of the emission surface EXP (a direction perpendicular to the center optical axis), is a line symmetry with respect to the normal line (center optical axis) of the emission EXP (the illuminance of the radiation angle having the same absolute value is different), the emission characteristic of the LED having this directivity is referred to as "asymmetric" emission characteristic.

The symmetry or asymmetry of the emission characteristic of the LED is not determined as a characteristic of each LED, but a unique distribution type is formed in the production facility where LEDs are manufactured. If the emission characteristic of the produced LED is close to a perfect circle, symmetry is guaranteed, but in actual production, the emission characteristic often has a distribution that is close to a perfect circle but is slightly distorted. In other words, mass produced chip LEDs in the industry normally have slightly asymmetric optical characteristics. These characteristics are determined by the manufacturing apparatus rather than the manufacturing dispersion of each LED. Therefore if LEDs are the same type, the asymmetry of the optical characteristics thereof normally have similar distribution.

Figure 13:
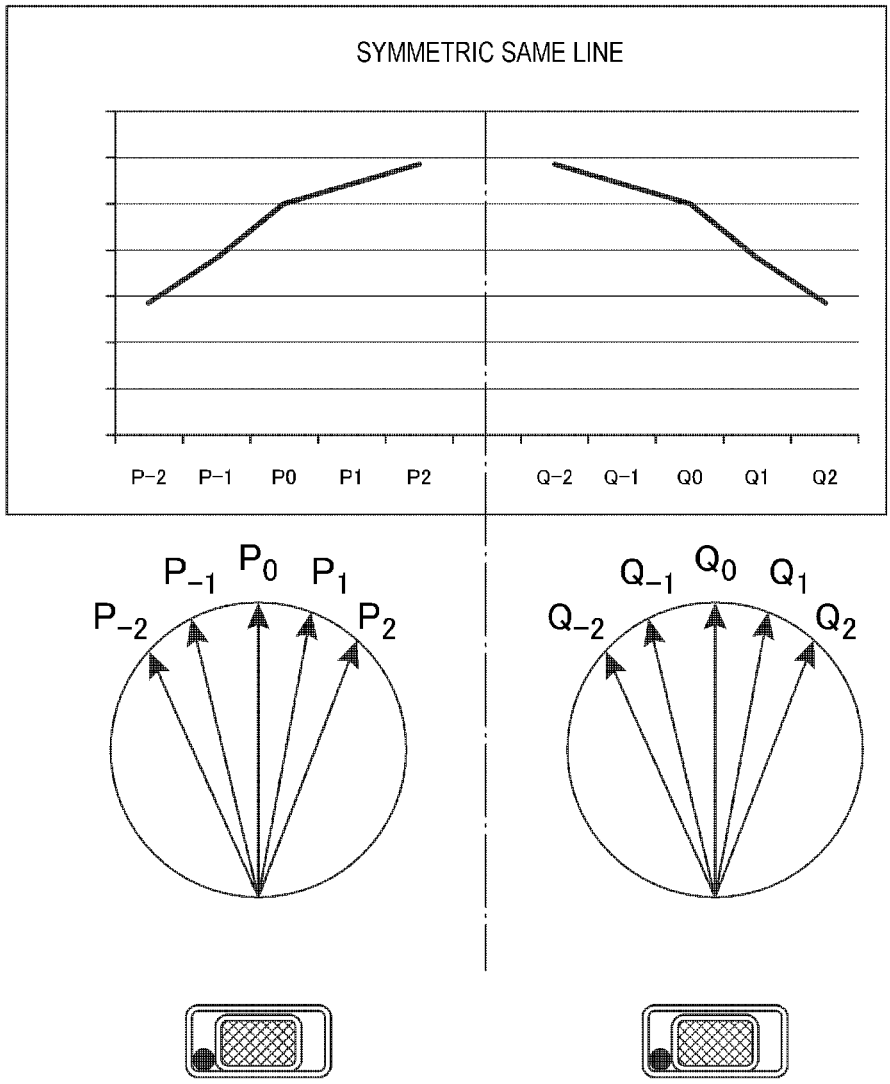
FIG. 13 is a diagram depicting the light irradiation distribution when symmetric LEDs are arranged side by side.

FIG. 13 shows the output distribution acquired by a linear image sensor when two identical type surface mount LEDs having ideal symmetry of light quantity distribution are used. In FIG. 13, the state of arranging each chip type LED on the substrate (relationship between the long side (longitudinal) and the short side of the LED package and the arrangement of the cathode mark), and the vector diagrams P and Q of the emission characteristic of the LED, are shown. The dashed line at the center of FIG. 13 corresponds to the Y axis in FIG. 3B mentioned above. If such LEDs having an ideal symmetric emission characteristic are used side by side, the acquired output is symmetric in an inverted V shape with respect to the Y axis at the center when the ordinate is the output of light quantity captured by the image sensor and the abscissa is a pixel position on the image sensor corresponding to each vector.

Figure 14:
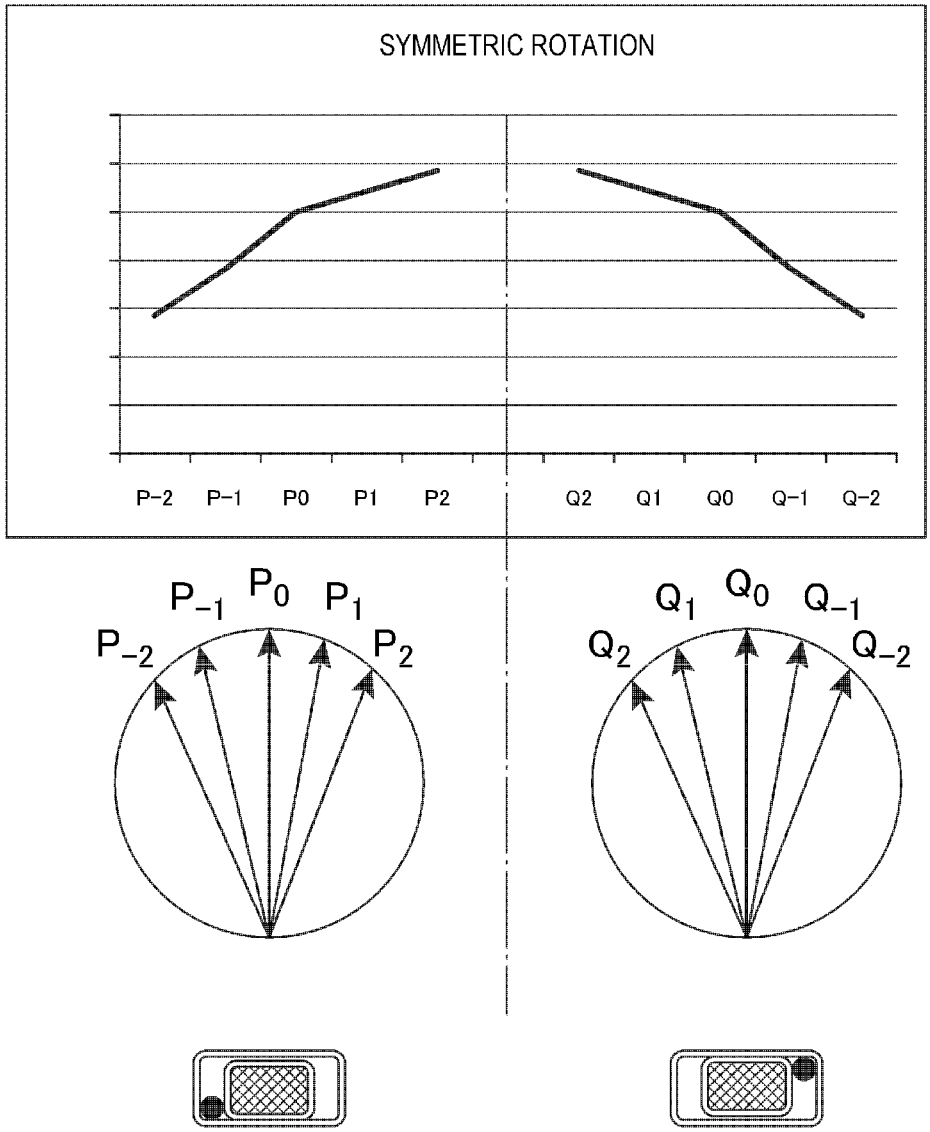
FIG. 14 is a diagram depicting the light irradiation distribution when symmetric LEDs are positioned in rotation.

FIG. 14 is a diagram when the LED at the right in FIG. 13 is rotated 180° without changing the position (the position of the cathode mark are horizontally reversed, and the position of each subscript of the vector Q is inverted). The output acquired by the image sensor is symmetric in an inverted V shape with respect to the Y axis at the center, which is the same as FIG. 13.

Figure 15:
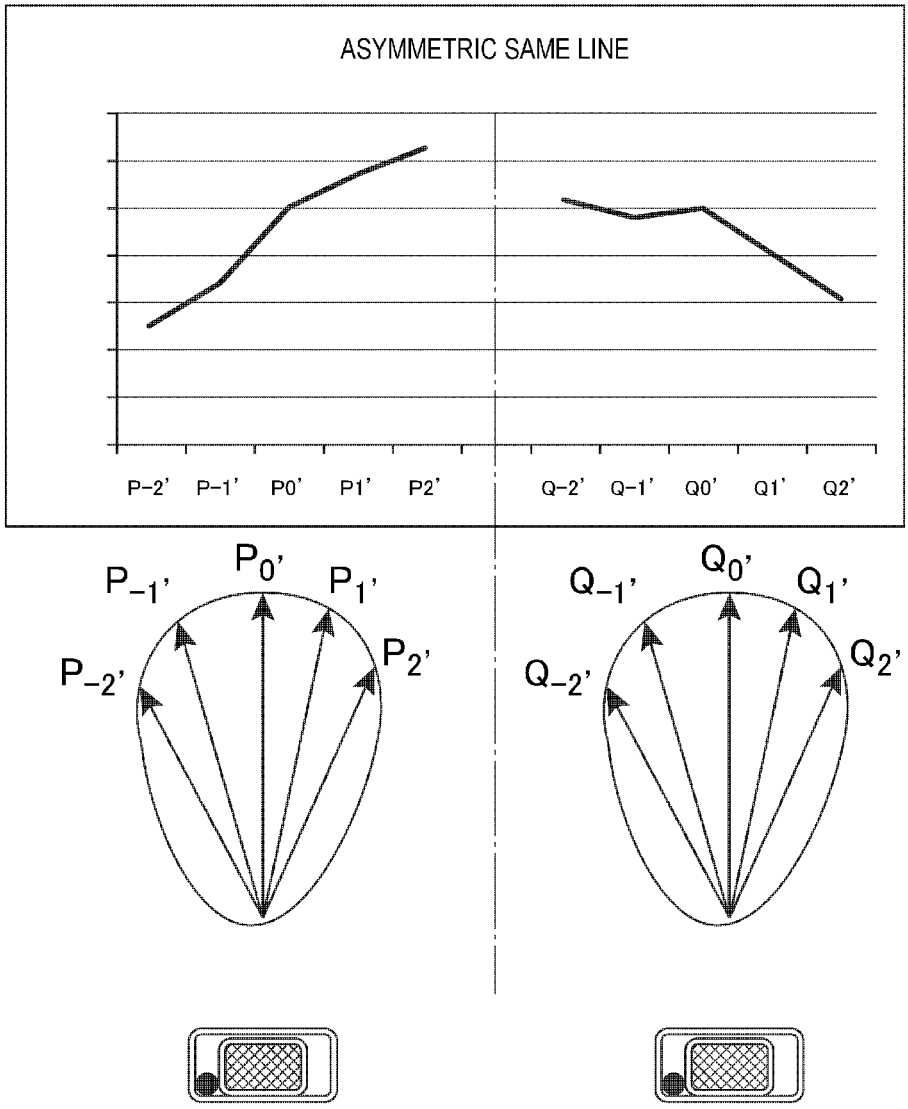
FIG. 15 is a diagram depicting a light irradiation distribution when asymmetric LEDs are arranged side by side.
Figure 16:
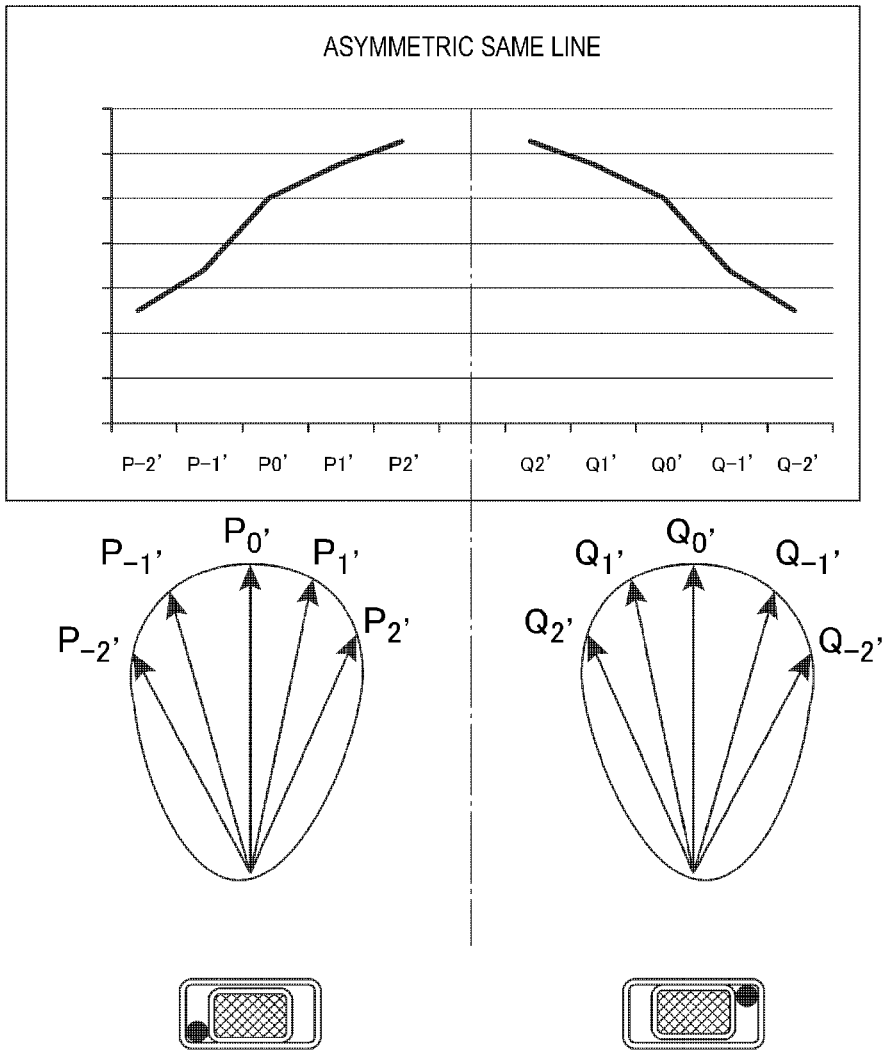
FIG. 16 is a diagram depicting a light irradiation distribution when asymmetric LEDs are arranged in rotation.

FIG. 15 shows the light quantity distribution when two identical type surface mount LEDs having asymmetric optical output characteristics are disposed side by side in the same orientation. The distribution of the output of the light from the left and right LED lights is shown as vector diagrams using P' and Q', which have similar asymmetry, respectively. In this case, the output of the image sensor is asymmetric with respect to the Y axis. FIG. 16 is a diagram showing when the LED at the right is rotated 180° or is approximately rotated 180° without changing the location (the orientation becomes point-symmetric with that of the LED on the left), and the output of the image sensor when the LEDs are emitted in this state (note the positions of the cathode marks) is shown. The image sensor output of each LED is line-symmetric in an inverted V shape with respect to the Y axis.

If two identical type light sources are line-symmetrically disposed side by side and light is irradiated in two directions like this, the LEDs having asymmetric light quantity distribution can be appropriately used if the orientations of the two light sources become point-symmetric. In other words, if the positions of the LED packages are line-symmetric with respect to the optical symmetric axis (Y axis in FIG. 3B) of the recording material detecting apparatus 60, the orientation of each LED is set in the position that is rotated 180° from each other (point-symmetric relationship) with respect to the emission center O (rotational phases of the two LEDs are shifted 180° from each other with respect to the emission center O). Thereby, a symmetric output characteristic can be acquired on the image sensor. In other words, the irradiation target object can be optically irradiated symmetrically, and the surface condition of the recording material can be more accurately detected, and as a result, the recording material identification accuracy improves.

Figure 17A:
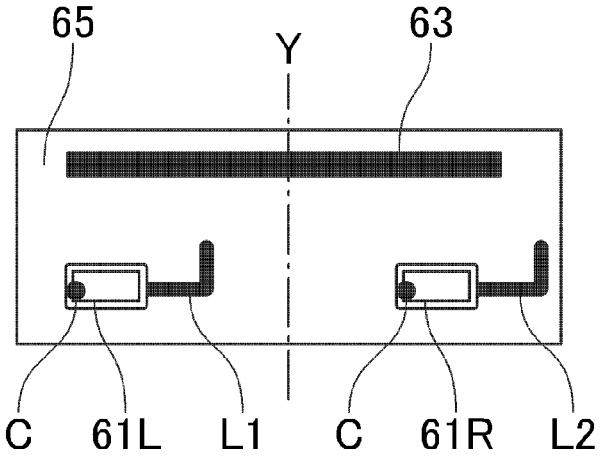
FIGS. 17A and 17B are diagrams depicting an LED power supply line.
Figure 17B:
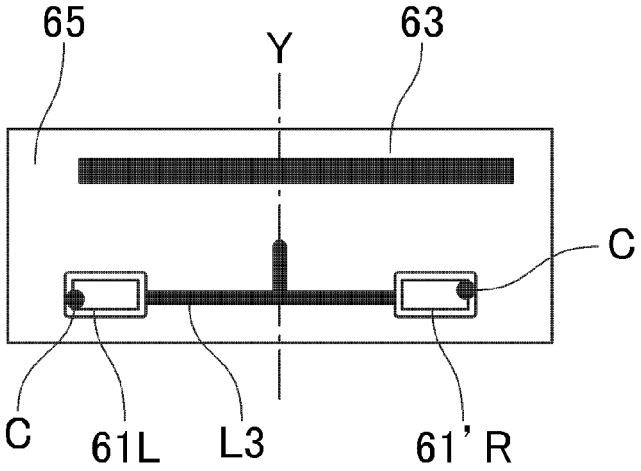

If the LEDs are arranged in line-symmetric positions and if each LED is rotated, the pattern of the power supply line to drive each LED can be shared, and the pattern area can be decreased. This will be described with reference to FIG. 17A and FIG. 17B. FIG. 17A shows a configuration when the LEDs are simply arranged in parallel (oriented in the same direction). FIG. 17B is a case when the packages are arranged side by side but the cathode positions are symmetric by rotating one of the packages (in the opposite orientation).

As FIG. 17A shows, if LEDs are arranged in the same orientation, the power supply lines L1 and L2 are individually wired to the LED 61L and the LED 61R, respectively, as shown by L1 and L2, each of which requires a mounting area. As FIG. 17B shows, on the other hand, if the packages are arranged in the same locations but one of the packages is turned to the opposite orientation so that the cathode marks C are symmetric, then the anode electrode portions (portions where power is supplied), which are disposed on the opposite side of the cathode electrode portions and to which the power supply line L3 is connected, face each other. If the anode electrode portions are positioned closer to each other like this, part of the power supply line L3 to be connected can be shared as shown by L3, wiring becomes efficient, and the pattern area becomes less wasteful.

When the center position of the LED package and the emission point center of the LED do not perfectly match, if the mounting position is determined based on the package shape, the emission distribution of the LED may deviate to the left or right. This means that merely arranging two LEDs in line-symmetric positions does not make emission distribution symmetric, and causes a difference in the emission peak position between the left and right LEDs; therefore, an appropriate amount of optical adjustment is required. According to this embodiment, conventional optical adjustment is unnecessary even if the package center position of the LED and the emission point center of the LED do not perfectly match. In other words, if the two LEDs are arranged line-symmetrically and the LEDs are rotated 180° from each other, influence of dispersion of misalignment of the chip emission point of the LEDs between the left and right LEDs can be decreased if the emission point misalignment of the LEDs is similar, and optical adjustment becomes unnecessary. Also manufacturing cost can be reduced by omitting this optical adjustment step.

As described above, according to this embodiment, two identical type light sources are arranged in line-symmetric positions with respect to the optical symmetric axis of the recording material detecting apparatus, where the orientations of the two light sources are point-symmetric (the rotational phases around the emission center of the two light sources are shifted 180° from each other). Because of this configuration, each reflected light image, which is formed in the imaging area of the imaging unit by each light source, has light quantity intensity distribution which is approximately line-symmetric with respect to the axis that orthogonally intersects the virtual segment connecting the centers of the reflected images at the center point of the segment. Each light source has a similar emission characteristic to each other, where the light quantity intensity distribution of the reflected light image in the imaging area of the imaging unit is asymmetric with respect to the above mentioned axis. In this emission characteristic, the intensity distribution changes depending on the installation orientation of the light source. According to this embodiment, light having a similar light quantity distribution can be irradiated onto the recording material from two directions, and highly accurate information on the surface condition of the recording material can be outputted, even if the apparatus is compact. Furthermore, the power supply line to each light source can be shared by the two light sources and the electric component mounting pattern area can be reduced, hence an apparatus which is compact, and has low cost and high precision to identify the surface condition of the recording material can be implemented.

Embodiment 2

Figure 18:
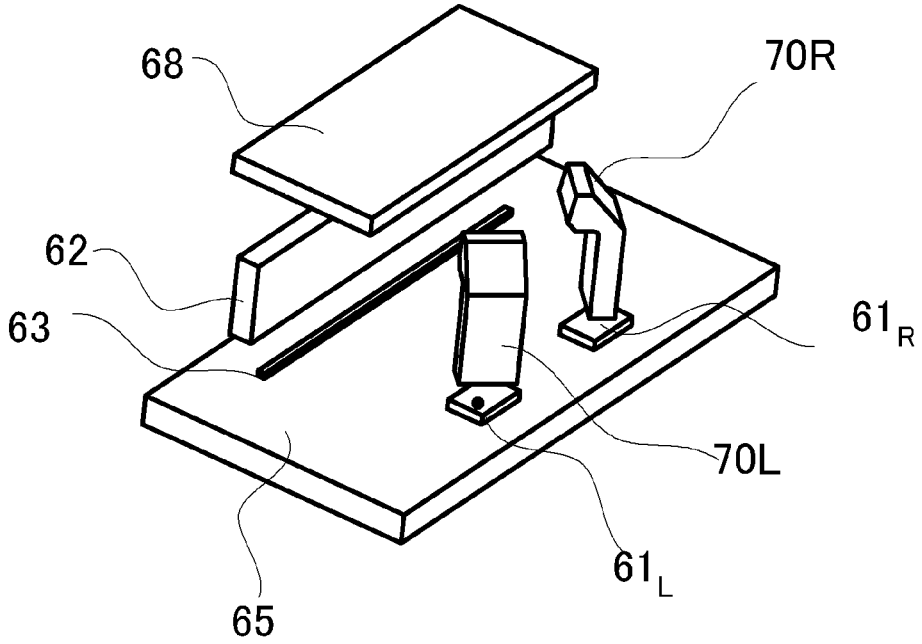
FIG. 18 is a diagram depicting a configuration of a recording material detecting apparatus according to Embodiment 2.
Figure 19:
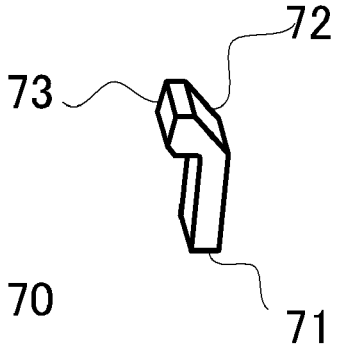
FIG. 19 is a diagram depicting a configuration of a light guide.
Figure 20:
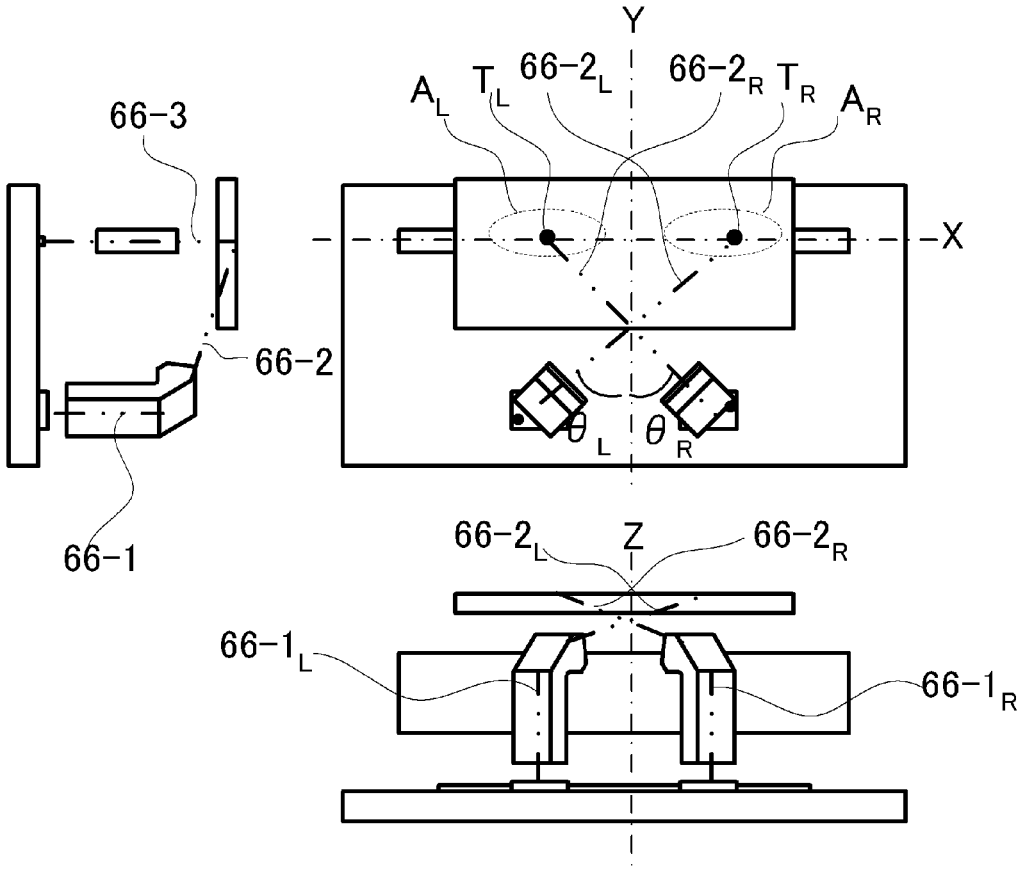
FIG. 20 is a diagram depicting the recording material detecting apparatus according to Embodiment 2 of the present invention.

A recording material detecting apparatus according to Embodiment 2 of the present invention will now be described with reference to FIG. 18 to FIG. 20. Description on information the same as Embodiment 1 is omitted here. The recording material detecting apparatus according to this embodiment has a function of the reflection unit of Embodiment 1, and two surface mounted LEDs that are arranged line-symmetrically and rotated 180° using a light guide (light guiding unit) that has a function to collect light. FIG. 18 is a schematic perspective view depicting a configuration of the recording material detecting apparatus according to this embodiment. Composing elements other than the light guide members 70 are the same as Embodiment 1, and the names and description of these composing elements are omitted. FIG. 19 shows a function of each surface of the light guide, and FIG. 20 shows the positional relationship of each component. The entire light guide 70 is molded by resin, such as acrylic resin.

The light guide (light guiding unit) 70 receives light irradiated from the two identical type LEDs 61, using a light guide bottom entrance face portion 71 that faces the LED 61, and collects the light into the light guide member and transmits the collected light through the light guide member. Then light is reflected by a light guide reflection surface 72, which is the reflection portion, and the light is emitted via a light guide emission portion 73. The light transmits through the cover member 68 and irradiates the periphery A around a target portion T as the optical center. The other reference symbols are the same as FIG. 3.

Even if the light guides are used like this, it is effective to arrange LEDs having asymmetry in line-symmetrical positions as each light source, and arrange each LED in a state rotated 180°. In other words, according to this embodiment, a similar effect as Embodiment 1 can be implemented. Further, the light collecting capability from the light sources increases since light guides are used, hence light quantity that can be irradiated onto the recording material reference surface can be increased, and the contrast ratio of the surface reference image generated by the surface condition increases when light is irradiated onto the recording material surface. Since two locations on the recording material surface irradiated with each LED can be irradiated at high light quantity in similar light quantity distribution states, respectively, the recording material surface condition images acquired by the irradiation are similar even if contrast is high. As a result, the recording material detection accuracy improves.

Embodiment 3

Figure 21:
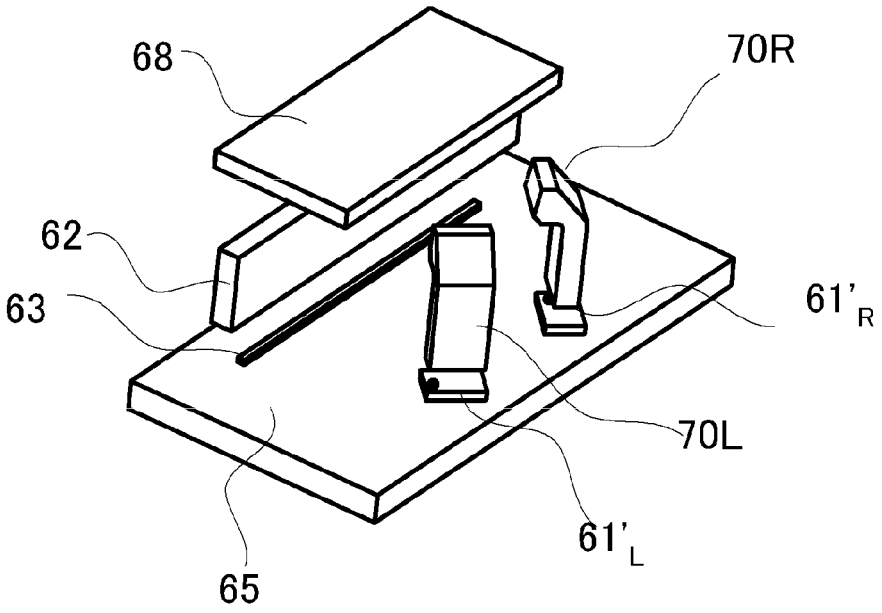
FIG. 21 is a diagram depicting a recording material detecting apparatus according to Embodiment 3 of the present invention.
Figure 22:
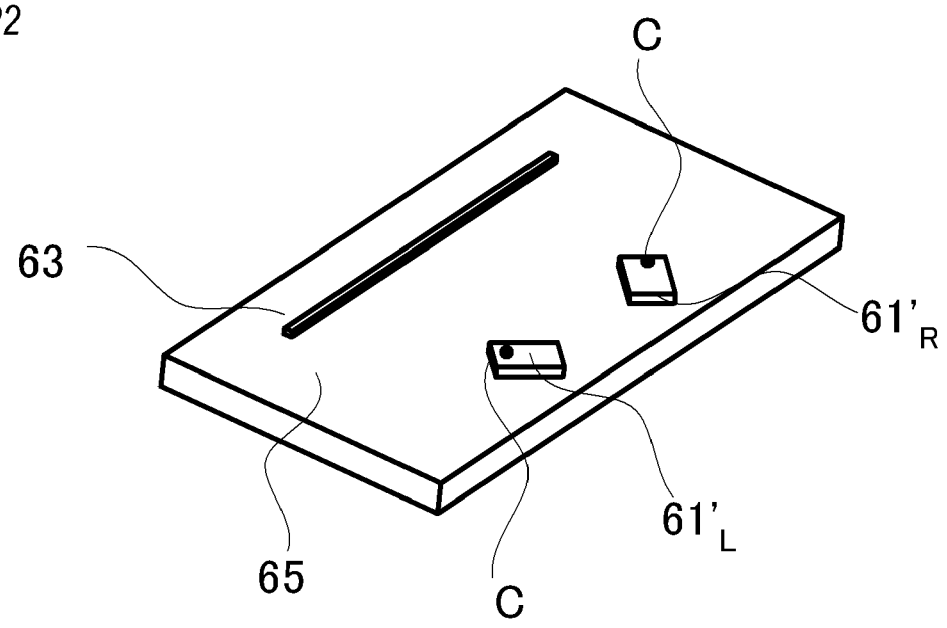
FIG. 22 is a diagram depicting the recording material detecting apparatus according to Embodiment 3 of the present invention.
Figure 23:
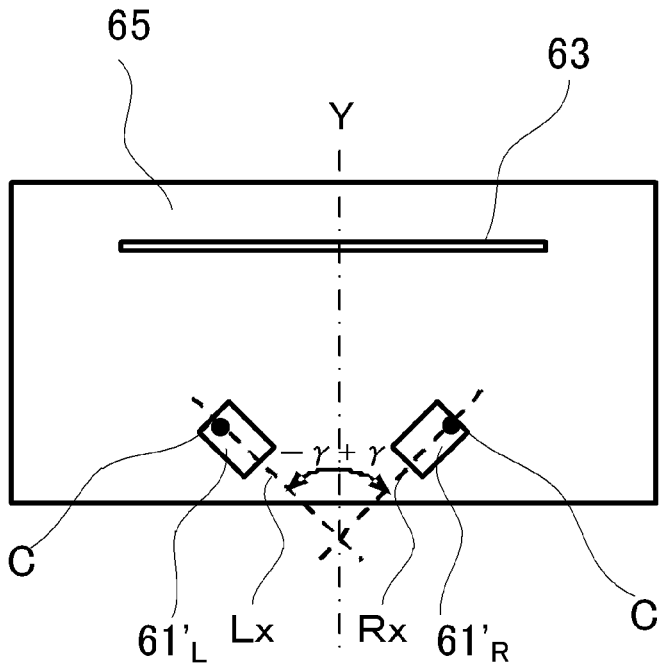
FIG. 23 is a diagram depicting the recording material detecting apparatus according to Embodiment 3 of the present invention.

A recording material detecting apparatus according to Embodiment 3 of the present invention will now be described with reference to FIG. 21 to FIG. 23. Description on information the same as the above mentioned embodiments is omitted here. This embodiment further improves the identification accuracy by increasing the light collecting capability which is implemented in Embodiment 2. FIG. 21 is a schematic perspective view depicting a configuration of the recording material detecting apparatus according to this embodiment. To assist in understanding, FIG. 22 (perspective view) and FIG. 23 (top view) show the package arrangement state of the LED. FIG. 23 is a view from a direction along the center optical axis of the two LEDs 61'L and 61'R.

As FIG. 21 shows, a rectangle of an entrance face of each light guide 70 is parallel with a rectangle of each package 61' of the two identical types of LEDs, respectively (long side directions of the rectangles are also parallel), and the light guides are arranged line-symmetrically at the left and right. The two LEDs at the left and right are arranged in different orientations (rotated 90° or approximately 90°) in such a way that the positions of the respective cathode marks are arranged line-symmetrically.

A general idea on the orientations of arranging LEDs will now be described. In this embodiment, the LED 61'L and the LED 61'R are arranged so that the reference lines Lx and Rx of the rotational phases of the LED 61'L and the LED 61'R around the center optical axis are substantially $+\gamma°$ and $-\gamma°$ (the clockwise direction is positive on the surface of the paper) from the optical symmetric axis Y of the recording material detecting apparatus (axis (straight line) in a direction perpendicular to the direction that the LED 61'L and the LED 61'R are lined up), when viewed from a direction along the center optical axis of the two identical type LED 61'L and LED 61'R, as shown in FIG. 23. Thereby, even if one of the two LEDs is not rotated 180° with respect to the other so that the rotational phase difference becomes 180°, as in the case of Embodiment 1 and Embodiment 2, the light quantity distributions of the light irradiated by the LED 61'L and the LED 61'R can be line-symmetrical with respect to the optical symmetric axis Y of the recording material detecting apparatus, just like Embodiment 1 and Embodiment 2. The configuration of Embodiment 1 and Embodiment 2 can be regarded as a configuration where the reference lines of the rotational phase are set to +90° and −90° with respect to the symmetric axis Y.

In FIG. 23, the reference lines Lx and Rx of the rotational phase of the LED 61'L and the LED 61'R are defined as lines parallel with the long side direction of the emission surface or the package, but the present invention is not limited to this. In other words, the reference line of the rotational phase is a virtual line for converting the rotational phase difference of the two LEDs into a numeral, and is a line that passes through the emission center O of the LED (position of the center optical axis), and is parallel with the emission surface of the LED, and therefore can be defined in any way only if the definition is the same for both the two LEDs. By defining the reference line of the rotational phase like this, and arranging the two light sources (LEDs) such that the respective reference lines of the rotational phases are substantially rotated by a same angle in opposite directions with respect to the symmetric axis Y, the light quantity distribution of the light irradiated by the two light sources can be line-symmetrical with respect to the symmetric axis Y.

Thereby, an illumination system, where the light is illuminated in two highly symmetric directions, can be optically implemented, just like Embodiment 1 and Embodiment 2. As a result, images to identify the surface condition of the recording material, having a similar light distribution state, can be acquired from two directions at high contrast ratio, which increases the image identification accuracy and improves the recording material identification accuracy. Furthermore, just like Embodiment 2, light emitted from the LEDs can efficiently enter into the light guide surface, and more quantity of light can be irradiated onto the target surface, and as a result, a surface image of the recording material with high contrast ratio can be acquired.

Embodiment 4

A recording material detecting apparatus according to Embodiment 4 of the present invention will now be described. Description on information the same as the above mentioned embodiments is omitted here. To assist description, comparison with the recording material detecting apparatus 40 according to Japanese Patent Application Laid-Open No. 2010-266432 described above is included.

Figure 24A:
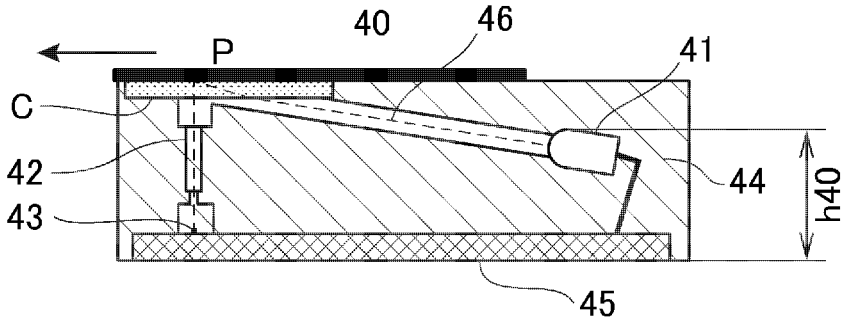
FIGS. 24A and 24B are diagrams depicting a recording material detecting apparatus according to a prior art.
Figure 24B:
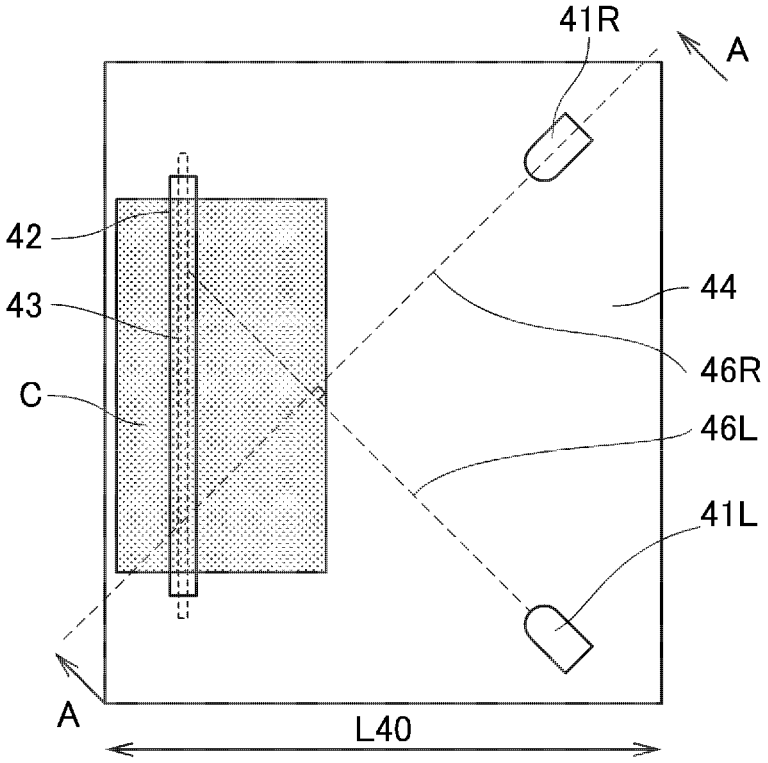

FIGS. 24A and 24B are schematic diagrams depicting a conventional recording material detecting apparatus 40, where FIG. 24A is a cross-sectional view at the A-A line in FIG. 24B, and FIG. 24B shows a top view of the apparatus (apart of a cover portion is transparent to clearly show the positions of the light sources and other components). The recording material detecting apparatus 40 has bullet type LEDs 41 as the light sources, of which height is h40 and which are disposed on a substrate 45 in the apparatus main unit 44. Lights are irradiated from these light sources onto a recording material P which moves in the arrow direction, through a cover member C at a shallow angle, about 10° to 15°, (an angle formed with the convey direction of the recording material P in FIG. 24A) by way of the optical paths 46. The reflected lights thereof are collected by a light collecting element (rod lens) 42, and the surface condition of the recording material P is imaged by an image sensor (CMOS line sensor) 43 where a plurality of photoelectric conversion elements is arranged in one direction on the substrate 45. At this time, as FIG. 24B shows, lights are irradiated from the light sources 41R and 41L onto the recording paper P in two directions of the optical path 46R and the optical path 46L, whereby the surface condition of the recording paper P can be detected without influence of the fiber orientation direction of the recording paper P. L40 denotes the width of the apparatus main unit.

Figure 25:
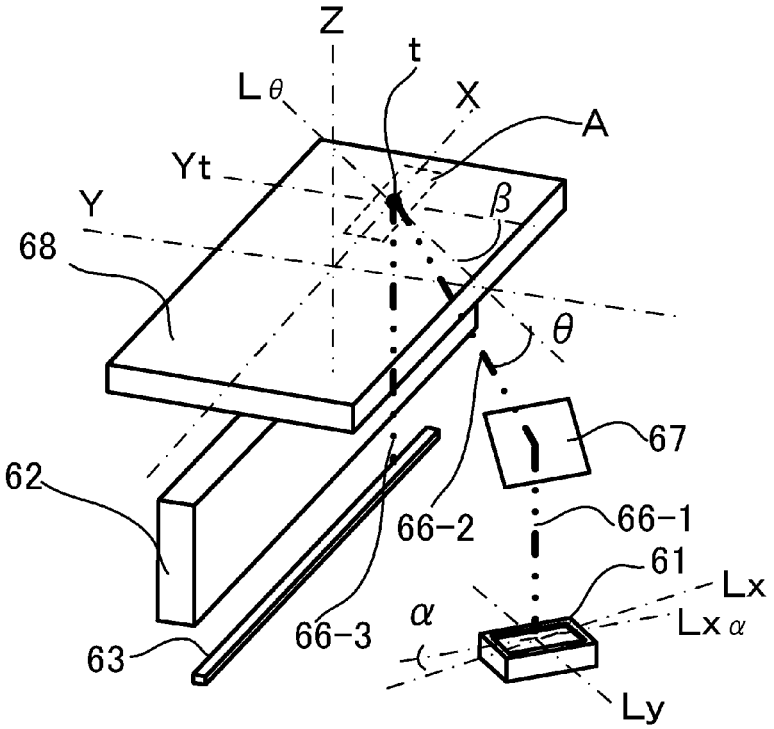
FIG. 25 is a diagram depicting a recording material detecting apparatus according to Embodiment 4 of the present invention.

FIG. 25 is a schematic perspective view depicting a configuration of a recording material detecting apparatus 60 according to this embodiment, and shows a three-dimensional configuration of each component, excluding the housing unit. Since the basic configuration is the same as the configuration in FIG. 2 described in Embodiment 1, description on the common portions of the configuration is omitted. In FIG. 25, Yt denotes a segment that is parallel with the Y axis and passes through a target t. An optical path 66-2 extends along a segment Lθ, which forms angle β with the segment Yt when the irradiation surface is viewed in the Z axis direction, and the light reflected by a reflection unit 67 is irradiated diagonally onto an area around the target position. The optical path 66-2 forms an angle θ with a segment Lθ on a virtual surface that includes the segment Lθ and intersects the irradiation surface orthogonally, and extends to the cover member 68 so that the light enters from the lower side of the cover member 68. An LED 61, which is a light source, is installed such that the long side direction of the rectangular package of the LED matches with the extending direction of a segment Lxα which is inclined by angle α from a segment Lx perpendicular to a segment Ly that is parallel with Lθ on the installation surface. Another light source and another reflection unit are disposed plane-symmetrically (mirror image position) with respect to a Y-Z plane formed by the Y axis and the Z axis, although the light source and the reflection unit are omitted in FIG. 25.

Figure 26A:
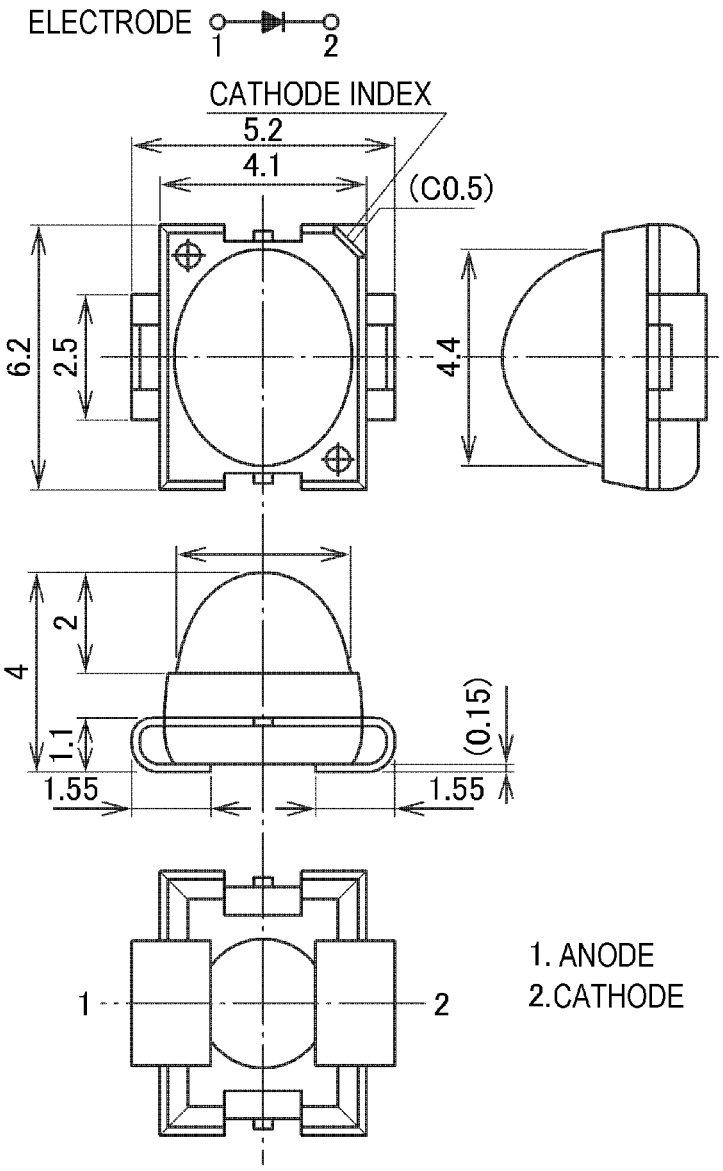
FIGS. 26A and 26B are diagrams depicting a configuration of a commercial LED having anisotropy.
Figure 26B:
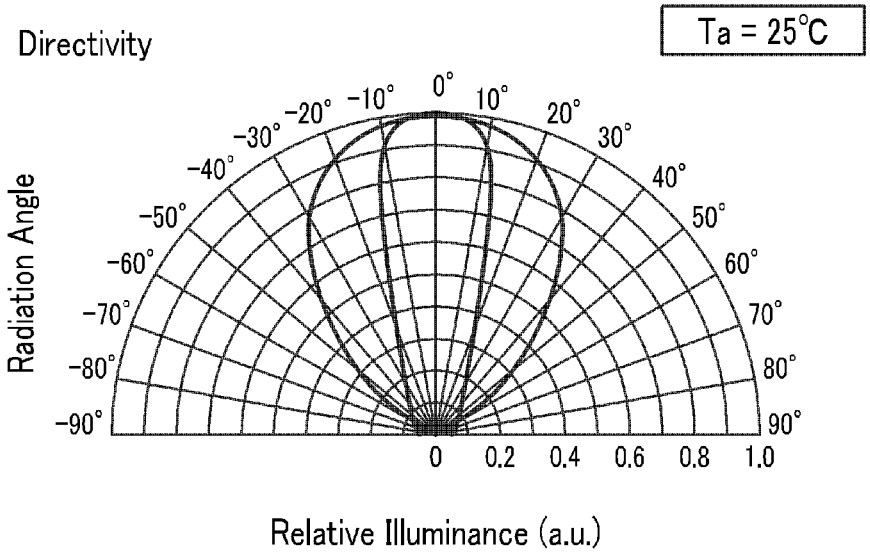

As a surface mount type LED, FIG. 26 shows an example of a configuration of a light source having anisotropy, with reference to an outside view and a directional characteristic diagram, excerpted from a catalog of Toshiba LED lamp TL□F1052 (T20) Series™. FIG. 26A shows a four-side outside views along with the dimensions of each portion. FIG. 26B shows a directivity of the LED where a value of the relative illuminance from the emission point is shown for each radiation angle. As this directivity diagram shows, the distribution of the irradiated light is different depending on the viewing direction. A large circle is the directivity when the viewing direction is the direction of the short side of the LED (direction of the long side of the LED is the horizontal axis), and a small circle is the directivity when the viewing direction is the direction of the long side of the LED (direction of the short side of the LED is the horizontal axis). An LED having this kind of directivity characteristic is defined as an LED having "anisotropy". Also, orthogonal directivity is indicated by the directions similar to those of the long side and the short side of the rectangular package of the LED, and the irradiation range of the short side is narrow.

Figure 27:
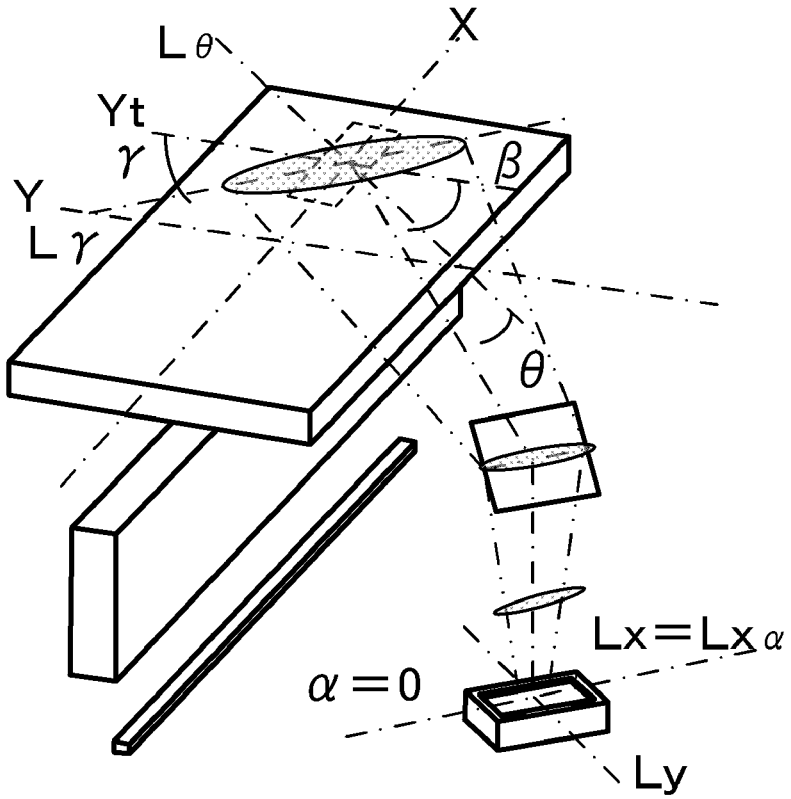
FIG. 27 is a diagram depicting a light irradiation distribution according to a conventional configuration.

FIG. 27 is a conceptual diagram depicting an irradiation range which is irradiated by light at a predetermined light quantity (illuminance) or more when the surface mount type LED having anisotropy is used. As FIG. 27 shows, the irradiation range of the light irradiated by the LED has a shape of an ellipse (approximately an ellipse). In other words, if a beam emitted from the surface mount LED having anisotropy is viewed in the optical axis direction, the portion of the light quantity distribution where the light quantity is a predetermined value or more has a shape of an ellipse of which the major axis generally matches the direction of the long side of the package of the LED. Only an area of which directivity is narrow will be used for description to clarify the situation. Let the optical axis of the irradiated light reflected by the reflection unit stand for an irradiated light axis Lθ projected onto the irradiated surface. The segment Ly is a segment parallel with the irradiated light axis Lθ on the LED installation surface. The segment Lx intersects orthogonally with the segment Ly (parallel with the irradiated light axis Lθ) on the LED installation surface. The LED is installed so that the anisotropy reference axis of the LED matches with the segment Lx; that is, the long side direction of the package of the LED matches with the segment Lx direction. The ellipse indicates an irradiation range of alight which is reflected on the rear side of the reflection unit, and then irradiated onto the transparent cover member in the figure. If the major axis direction of the irradiated ellipse light is the segment Ly, then an angle formed with the segment Yt is angle γ.

Figure 28:
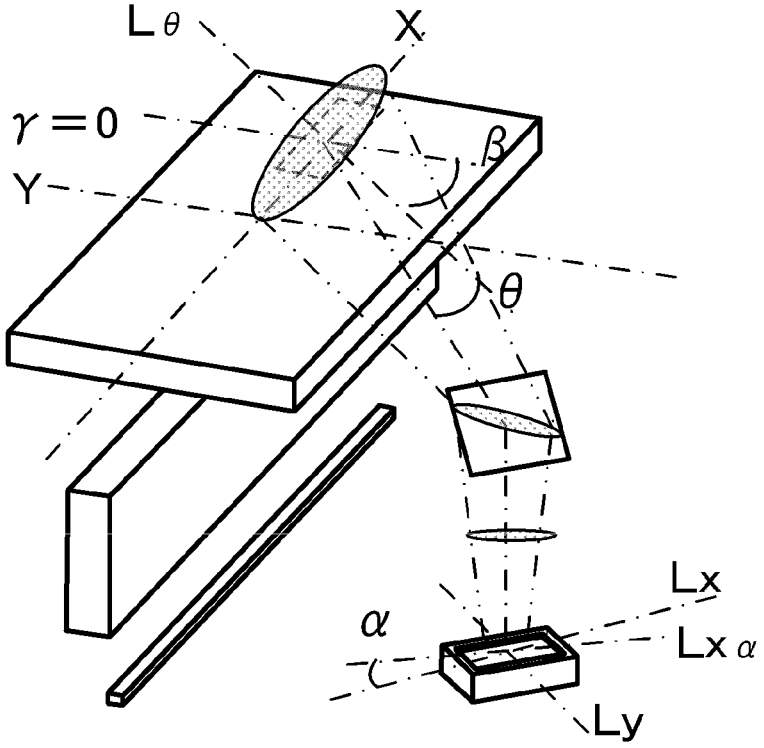
FIG. 28 is a diagram depicting a light irradiation distribution according to Embodiment 1 of the present invention.

FIG. 28 indicates the irradiation range when the package of the LED having anisotropy is installed inclining by α from the segment Lx, perpendicular to the segment Ly, which is parallel with the irradiated light axis Lθ of the irradiated light. By setting the optical path adding a predetermined screw angle α, the major axis Lγ of the ellipse that indicates the irradiation range can be matched with the X axis that is on the same axis as the observation axis of the image sensor (parallel with the array direction of the photoelectric conversion elements in the image sensor, which is parallel with the long side (longitudinal) direction of the long (elongated shape) imaging area used by the image sensor) (γ=0°).

Figure 29:
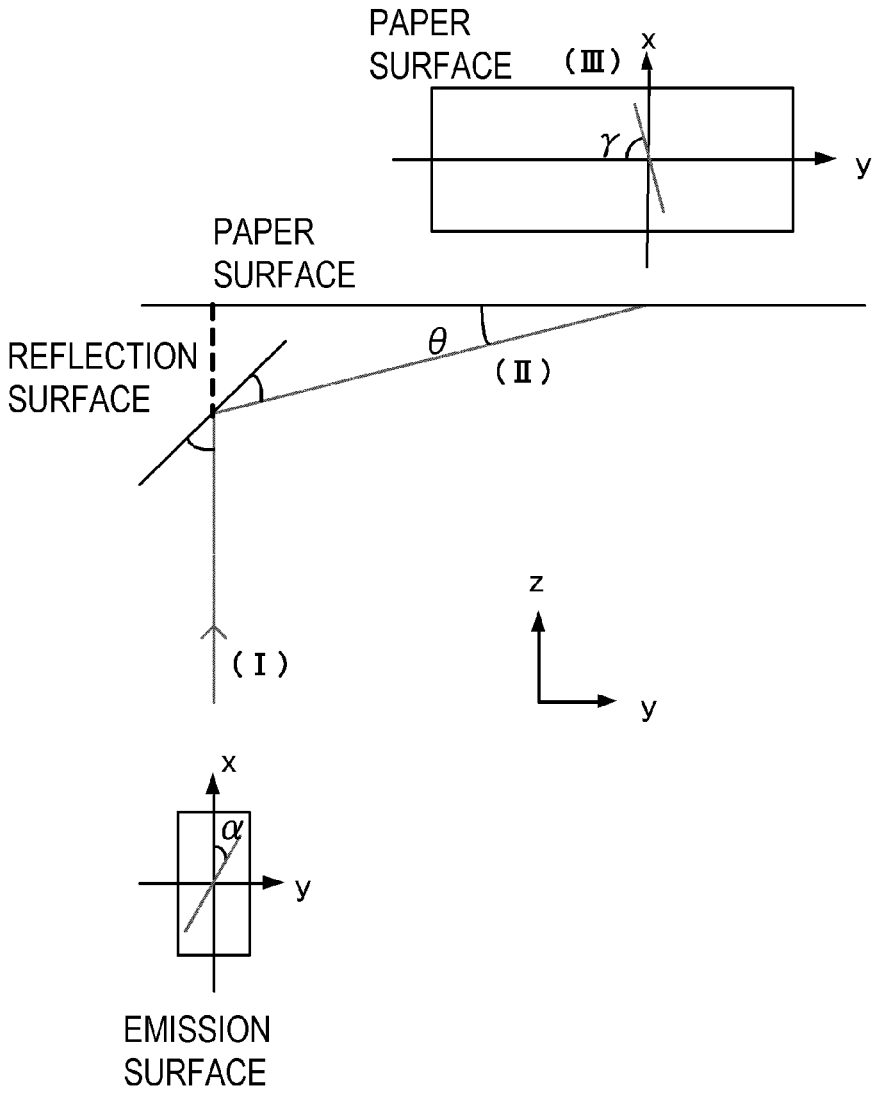
FIG. 29 is a model diagram depicting the entire optical axis.

Now the relationship between each optical path from the light source to the irradiation target recording material surface via the reflection surface will be further described. FIG. 29 shows a model diagram for determining an inclination angle γ of the beam on the surface of the paper from the screw angle (inclination angle of the optical axis of the LED) α and the incident angle θ to the surface of the paper, where the state of the beam (I) from the emission surface (x-y plane) having the screw angle (inclination of anisotropic reference axis) α, abeam (II) on the y-z plane reflected by the reflection surface, and the screw angle γ on the x-y plane when the beam II is irradiated onto the surface of the paper at the incident angle θ.

Figure 30:
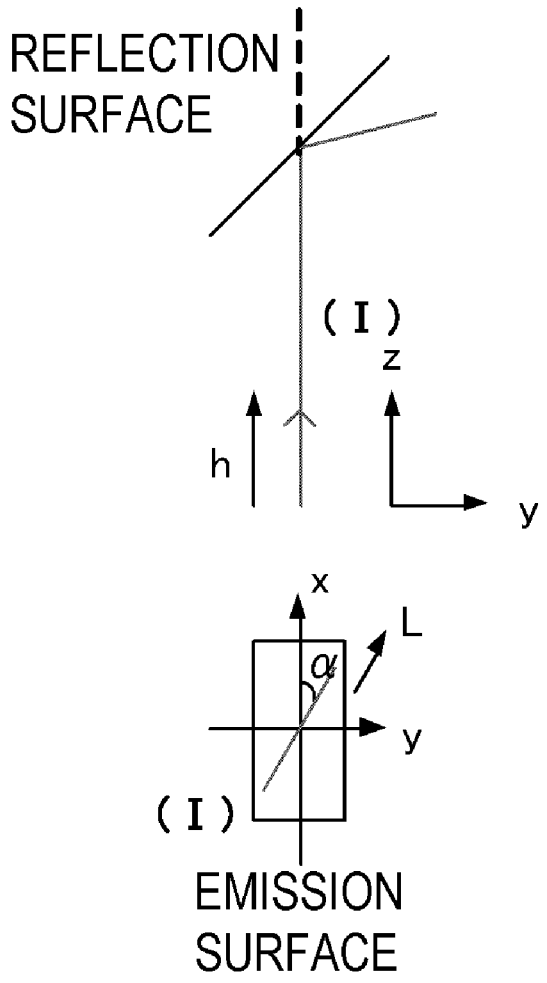
FIG. 30 is a diagram depicting the optical axis model formula (emission surface)

First the model formula of the beam (I) from the emission surface is given by the following expression if FIG. 30 is used.

$$(\mathrm{I})(L\cos\alpha,\ L\sin\alpha,\ h) \tag{1}$$

Figure 31:
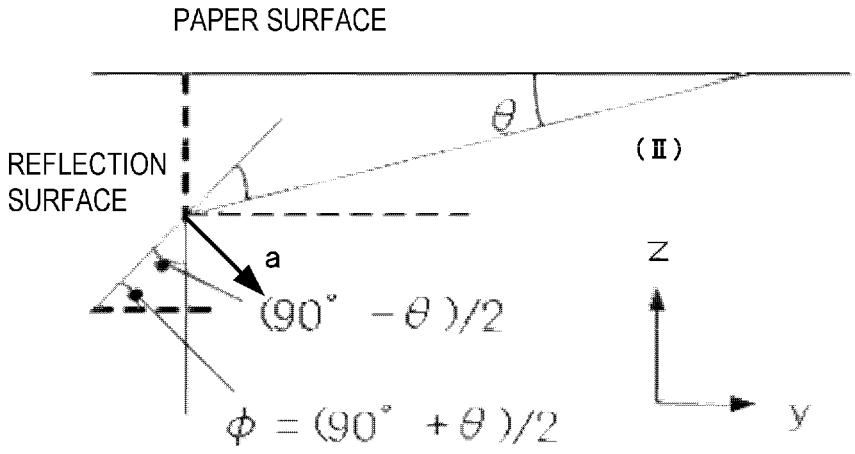
FIG. 31 is a diagram depicting the optical axis model formula (reflecting surface)

Then the model formula of the beam (II) after reflection is shown using FIG. 31.

Here the normal vector a on the reflection surface is given by $$(x, -\sin\phi, \cos\phi) \tag{2}$$

This is given by the expression on the yz plane using the mirror transformation matrix of the reflection surface.

$$\left(\delta_{ij} - 2\frac{a_i a_j}{\|a\|^2}\right) = \begin{pmatrix} 1-2\sin^2\phi & -2\sin\phi\cos\phi \\ -2\sin\phi\cos\phi & 1-2\cos^2\phi \end{pmatrix} = \begin{pmatrix} \cos 2\phi & \sin 2\phi \\ \sin 2\phi & -\cos 2\phi \end{pmatrix} = \begin{pmatrix} -\sin\theta & \cos\theta \\ \cos\theta & \sin\theta \end{pmatrix} \tag{3}$$

Here, $$\delta_{ij} = \begin{cases} 1 & i = j \\ 0 & i \neq j \end{cases}$$

is satisfied.

By performing mirror transformation on Expression (1) using Expression (3), the model formula of the beam (II) after reflection is determined.

$$\begin{pmatrix} -\sin\theta & \cos\theta \\ \cos\theta & \sin\theta \end{pmatrix} \cdot \begin{pmatrix} L\cdot\sin\alpha \\ h \end{pmatrix} \tag{4}$$

Model formula without x component $$\rightarrow(h\cos\theta - L\sin\alpha\sin\theta,\ L\cos\theta\sin\alpha + h\sin\theta) \tag{5}$$

Model formula with x component $$\rightarrow(\mathrm{II})(L\cos\alpha,\ h\cos\theta - L\sin\alpha\sin\theta,\ L\cos\theta\sin\alpha + h\sin\theta) \tag{6}$$

Figure 32:
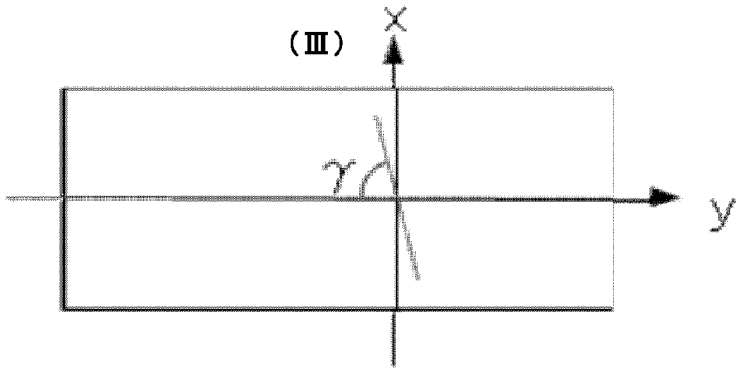
FIG. 32 is a diagram depicting the optical axis model formula (surface of paper)

Then the model formula of the beam (III) on the surface of the paper is determined using FIG. 32.

Since the model formula on the Z=0 plane is determined, the following is given based on Expression (6).

$$L\cos\theta\sin\alpha + h\sin\theta = 0 \tag{7}$$

Based on Expression (7), $h = -L\sin\alpha\cos\theta/\sin\theta$ is substituted, and h is deleted. Then beam (III) on the surface of the paper is given by the following expression.

$$(\mathrm{III})(L\cos\alpha,\ -L\sin\alpha/\sin\theta,\ 0) \tag{8}$$

Therefore the formula to determine the screw angle γ on the surface of the paper becomes as follows.

$$\gamma = 90° + \tan^{-1}(-\sin\alpha/(\sin\theta\cos\alpha))$$

Figure 34:
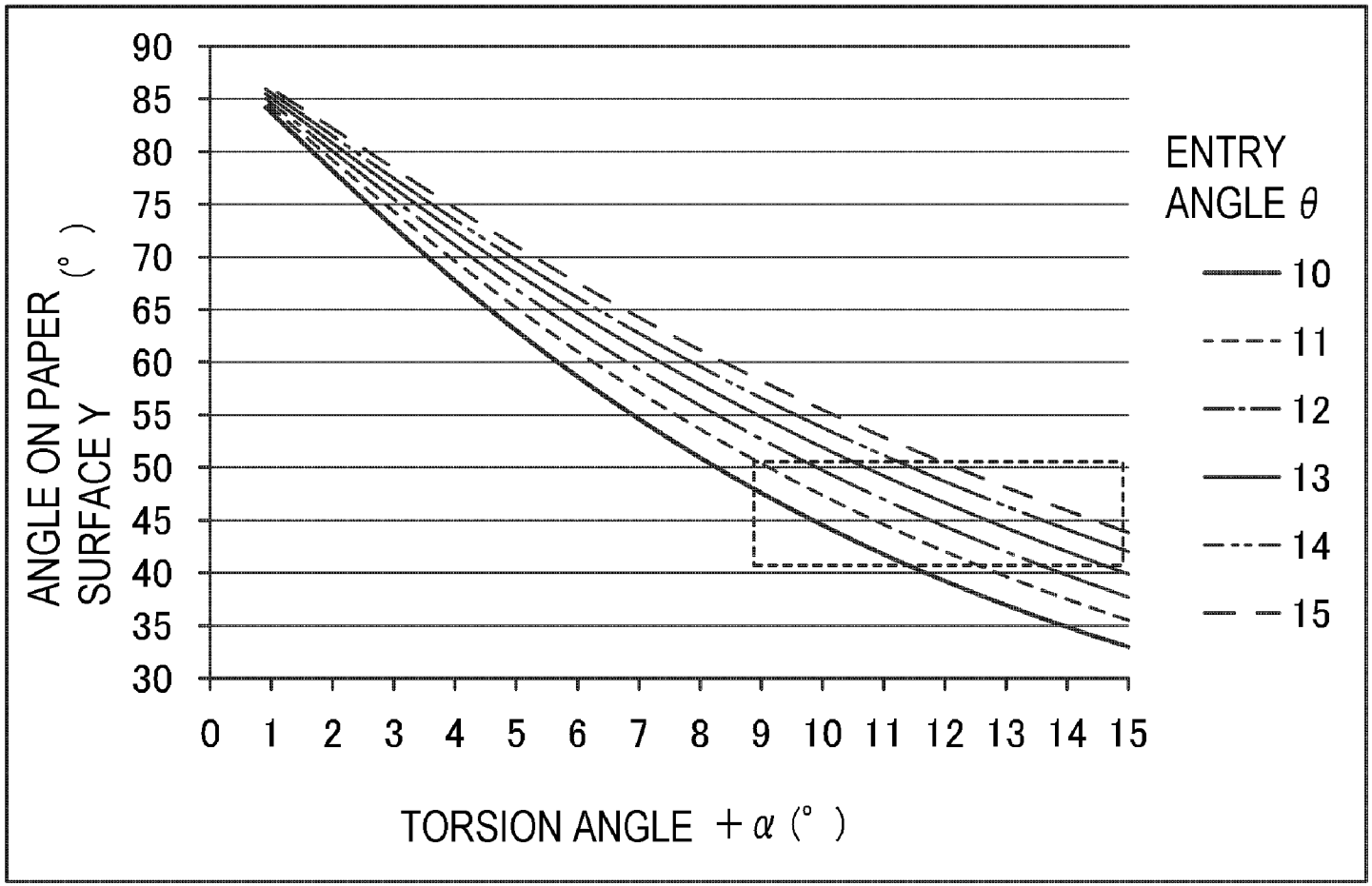
FIG. 34 is a graph showing screw angles.

FIG. 33 and FIG. 34 show the numeric calculation result. The screw angle γ is preferably 45°, but 45°±5° is appropriate if dispersion in manufacturing is considered. To acquire sufficient contrast during illumination, the incident angle (entry angle) θ is preferably 10° to 15°. For the screw angle (screw angle of the LED optical axis) α, an appropriate angle is 9° to 15° from the initial setting angle. The range is shown by the broken lines surrounded by the square in FIG. 34.

If an LED having anisotropy in directivity is used, and the major axis or the minor axis (anisotropic reference axis) of an ellipse indicating the irradiation range of the LED is inclined by a predetermined degree, then direction of the distribution of the irradiated light with respect to the image sensor can be controlled. This means that a noise light component that enters from undesirable directions can be controlled when the surface of the recording material is imaged by the image sensor.

Figure 35:
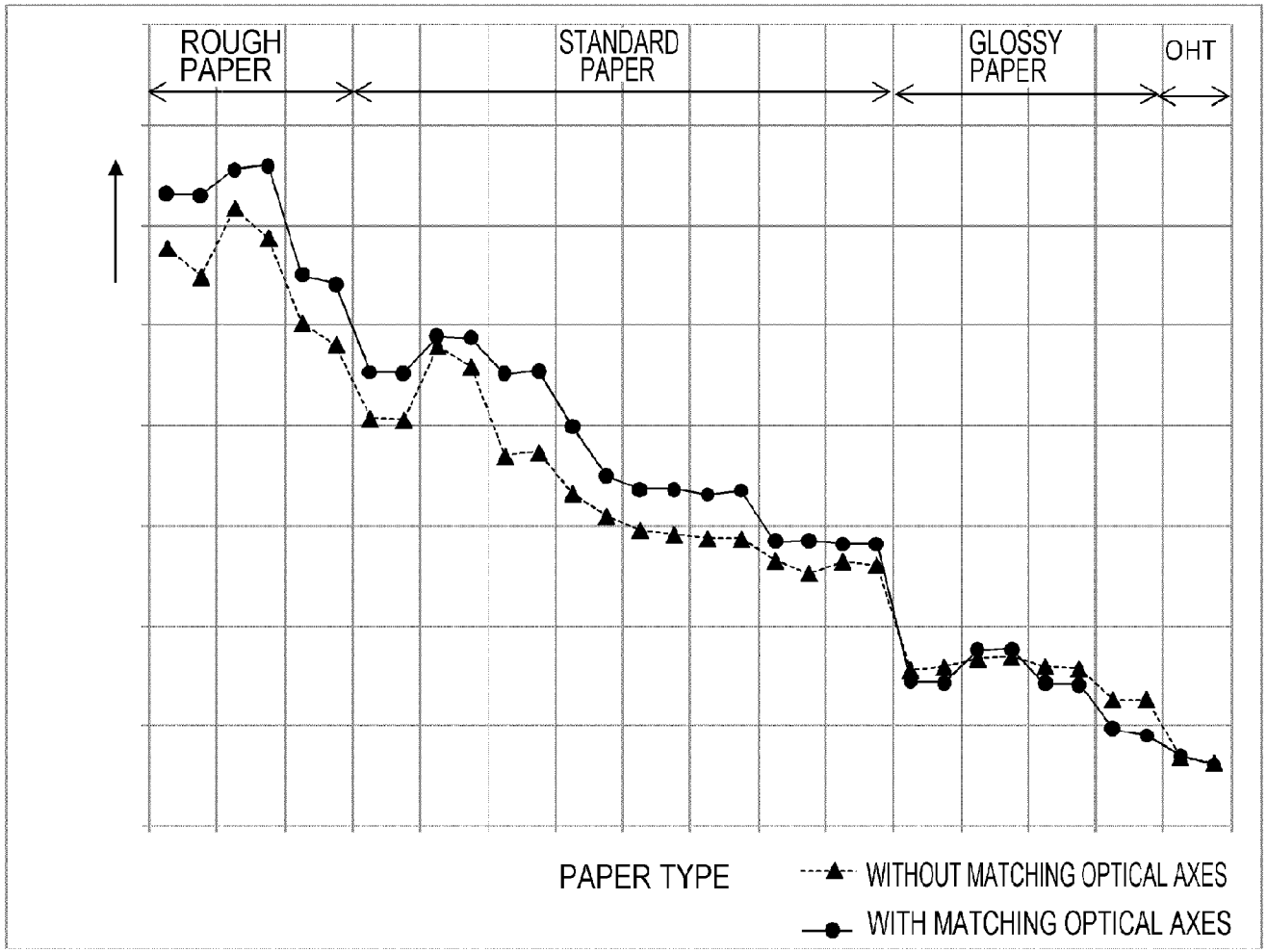
FIG. 35 is a graph showing an evaluation result of Embodiment 4 of the present invention.

This effect is confirmed as follows. Various recording materials are selected and classified into four types: rough paper of which surface is rough, standard paper which is normally used in offices, glossy paper of which surface is smooth and glossy, and transparent resin sheet material (OHT), and the difference of these surface conditions is observed. FIG. 35 shows the result. The abscissa indicates the surface roughness of each recording material, and the ordinate indicates a measured lightness correspondence value with respect to the surface roughness. By comparing the output values corresponding to lightness, the surface condition can be judged. Here (-▲-) indicates that the anisotropic reference axes of the LED are not matched with the distribution axis direction of the image sensor, and (-●-) indicates that these axes are matched.

As the lower right side of FIG. 35 shows, in the case of the smooth paper, there is almost no difference whether the optical axes are matched or not. However, in the case of the paper of which surface is rough and the standard paper shown at the upper left side of FIG. 35, the output increases when the optical anisotropy is matched as compared to when the optical anisotropy is not matched, as the upward arrows show. This is because if the surface condition of the recording material is relatively rough, the lightness output correspondence value increases depending on the type of the recording material; that is, the S/N ratio, to identify the type of the recording paper, increases (signal S becomes larger). As a result, if the lightness output values are classified by the surface condition of the recording material, the surface condition of each area can be more easily identified, so identification accuracy of the recording paper improves.

Here the lightness output correspondence value of the glossy paper of which surface condition is relatively smooth is detected as a value sufficiently lower than that of standard paper, indicating that each recording material type can be identified.

Thus, according to this embodiment, light sources having anisotropy are used and the irradiated lights are entered at a predetermined screw angle via the reflection unit, whereby the light can be directly irradiated onto the recording paper from two directions even if the apparatus is compact. As a result, the light can be directly irradiated onto the recording paper at a shallow angle regardless of the fiber orientation direction of the recording paper, and a high contrast surface condition image of the recording paper can be acquired. Furthermore, sufficient irradiated light quantity on the surface of the recording paper can be secured, and optical noise components are few, so an apparatus having high accuracy to identify the recording paper can be implemented.

Embodiment 5

A recording material detecting apparatus according to Embodiment 5 of the present invention will now be described. Description on information the same as the above mentioned embodiments is omitted here. According to a configuration of this embodiment, the portion of the reflection unit shown in the detailed configuration of Embodiment 4 is used, and at the same time, a light guide having a function to collect light is integrated, and the optical axis of the surface mount LED is inclined at a predetermined angle.

Figure 36:
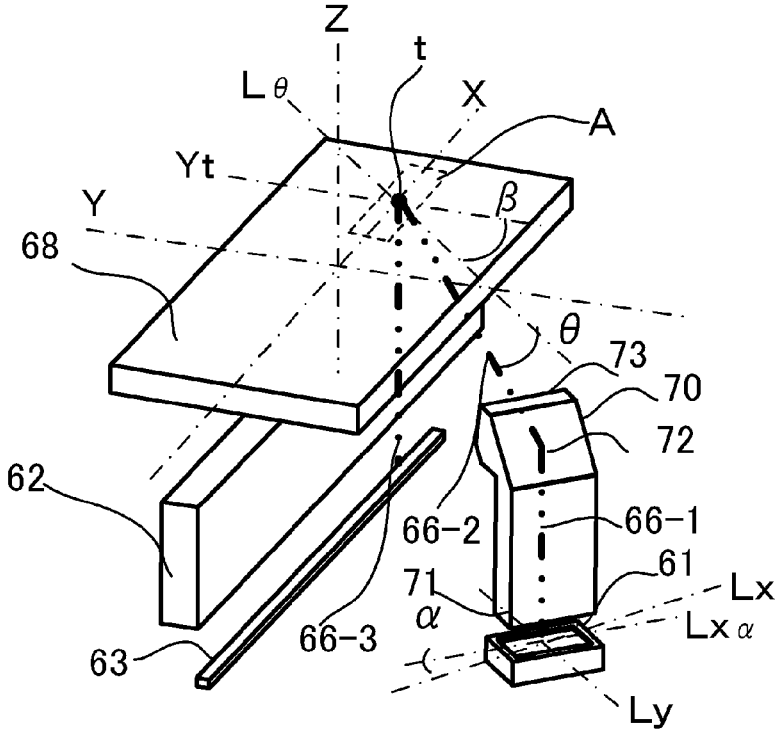
FIG. 36 is a diagram depicting a configuration of a recording material detecting apparatus according to Embodiment 5 of the present invention.

FIG. 36 is a schematic perspective view depicting the configuration of the recording material detecting apparatus according to this embodiment, and shows a three-dimensional configuration of each component, excluding the housing unit. Since the configuration other than a light guide member 70 in FIG. 36 is the same as the configuration described in the above embodiments, the name and description of each component is omitted. The entire light guide 70 is molded by resin, such as acrylic resin, and receives light irradiated from an LED 61 using a bottom entrance face portion 71 that faces the LED. After the light is collected and transmitted into the light guide member, the beam is reflected by the reflection surface 72 which is a light deflecting portion, and then the beam is emitted via an emission portion 73. The light transmits through the cover member 68 and irradiates the periphery around a target portion t as an optical center. Another LED 61 and another light guide 70 are arranged line-symmetrically with respect to the Y axis, although this is omitted in FIG. 36, whereby irradiation of the light onto the recording material from two directions is implemented.

Figure 37:
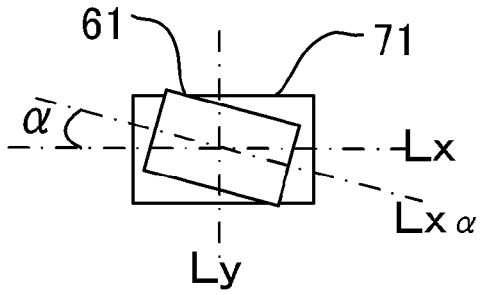
FIG. 37 is a diagram depicting a positional relationship of an LED and a light guide according to Embodiment 5 of the present invention.
Figure 38:
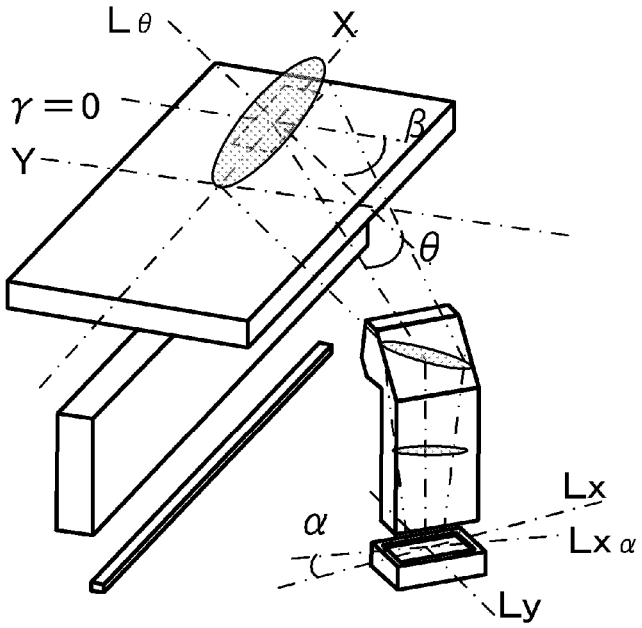
FIG. 38 is a diagram depicting a light irradiation distribution according to Embodiment 5 of the present invention.

FIG. 37 is a schematic diagram depicting a positional relationship between the LED 61 and the light guide 70. As FIG. 37 shows, the long side direction of the bottom entrance face 71 of the light guide 70 is parallel with the segment Lx, and the direction of the short side is the same as the direction of the segment Ly. The vertical and horizontal directions of the segment Ly parallel with the optical center axis segment Lθ, and the segment Lx perpendicular to the segment Ly and the bottom entrance face 71 of the light guide 70 match. The outer package of the LED 61 having anisotropy in the package direction is located in position Lxα, which is inclined by angle α from the segment Lx. The irradiation range of the light irradiated onto the cover member is indicated by the ellipse shown in FIG. 38.

By providing a desired screw angle α like this, the distribution of the irradiated light matches with the scanning axis direction of the line sensor. In other words, according to this embodiment, a sufficient quantity of irradiation light, even more than Embodiment 4, can be acquired because of the light collecting function of the light guide and light irradiation with optically low noise component is implemented. Therefore, the lightness correspondence value, measured when the surface condition of the recording material is observed and compared, is acquired as a better S/N ratio. As a result, the recording material identification accuracy improves.

Embodiment 6

A recording material detecting apparatus according to Embodiment 6 of the present invention will now be described. Description on information the same as the above mentioned embodiments is omitted here.

In Embodiment 4 and Embodiment 5, the irradiation directions are set from two diagonal directions to the recording material using the reflection units, and the irradiation directions from the reflection units are plane-symmetric with respect to the Y-Z plane in the convey direction. However, the reflection units may be disposed axial-symmetrically with respect to a segment that is parallel with the Z axis, passing through the intersection of the two irradiation directions. If the bases of the reflection surfaces are molded by resin on the inner wall face of the member and the reflecting objects are glued thereon, as in the case of Embodiment 4, a relatively free design is allowed for the reflection direction of the optical system. But in the case of Embodiment 5, even if a plurality of line guide members having a reflection surface is used, it is preferable, from an industrial standpoint, that these light guide members have identical shapes. From an optical standpoint, however, more efficient optical characteristics can be implemented if the light guide members are arranged in independent positions which are optically appropriate, respectively, with respect to the light entering direction. In other words, if a specific reflection/deflection angle is provided to each of the left and right light guides so that the respective reflection angle is optimized, then more efficient light quantity can be irradiated onto the recording material surface. In this case as well, if the anisotropic axis characteristic of the emission light quantity distribution of the LED to be the irradiation source is appropriately set and matched with the reference axis of the image sensor, then light quantity can be irradiated onto the target surface even more efficiently, and an illumination system which has optically low noise can be implemented. As a result, recording material identification accuracy can be improved.

Each of the above embodiments can be combined with each other in a configuration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-172362, filed Aug. 2, 2012, which is hereby incorporated by reference herein in its entirety.

What is claimed is:

1. A recording material detecting apparatus, comprising:

a first light source that emits first light;

a second light source that emits second light;

a light guiding unit that allows the first light and the second light to enter a surface of a recording material respectively in two directions which are not parallel when viewed in a normal line direction of a surface of the recording material;

an imaging device that images an area where the first light is irradiated and an area where the second light is irradiated on the surface of the recording material; and an output device that outputs information on a surface condition of the recording material based on an output of the imaging device, wherein the second light source is a light source of a type which is the same as that of the first light source, and wherein when viewed in a direction along center optical axes of the first light source and the second light source, the first light source and the second light source are arranged such that respective reference lines of rotational phases around the center optical axes are rotated in opposite directions by approximately the same angles from a line perpendicular to a direction in which the first light source and the second light source are arrayed.

2. The recording material detecting apparatus according to claim 1, wherein the first light source and the second light source each have an emission characteristic such that the irradiation distribution thereof is asymmetric with respect to the center optical axis when viewed in a direction perpendicular to the center optical axis.

3. The recording material detecting apparatus according to claim 1, wherein when viewed in a direction along the center optical axes of the first light source and the second light source, the first light source and the second light source are arranged such that the respective reference lines of the rotational phases around the center optical axes are rotated in opposite directions by approximately 90° from the line perpendicular to the direction in which the first light source and the second light source are arrayed.

4. The recording material detecting apparatus according to claim 3, wherein the arrangement in opposite directions is an arrangement where respective power-supplied portions of the first light source and the second light source face each other, and wherein the power-supplied portion of the first light source and the power-supplied portion of the second light source are connected to a common power supply line.

5. The recording material detecting apparatus according to claim 1, wherein the light guiding unit includes:

a guide portion that collects the first light and the second light; and a reflection portion that reflects the collected light so that an incident angle with respect to the recording material becomes a predetermined angle.

6. A recording material detecting apparatus, comprising:

a first light source that emits first light;

a second light source that emits second light;

a light guiding unit that allows the first light and the second light to enter a surface of a recording material respectively in two directions which are not parallel when viewed in a normal line direction of a surface of the recording material;

an imaging device that images an elongated shape imaging area irradiated with the first light and the second light on the surface of the recording material; and an output device that outputs information on a surface condition of the recording material based on an output of the imaging device, wherein on the surface of the recording material, an area irradiated with the first light, a light quantity of which is a predetermined value or more,. and an area irradiated with the second light, a light quantity of which is a predetermined value or more, are approximately elliptical areas, respectively, and wherein the first light source and the second light source are arranged so that major axes of the elliptical areas are parallel to a longitudinal direction of the imaging area, respectively.

7. The recording material detecting apparatus according to claim 6, wherein the imaging device is a line sensor in which a plurality of photoelectric conversion elements are arrayed in one direction, and the longitudinal direction of the imaging area is parallel with the direction in which the plurality of photoelectric conversion elements are arrayed.

8. An image-forming apparatus, comprising:

a first light source that emits first light;

a second light source that emits second light;

a light guiding unit that allows the first light and the second light to enter a surface of a recording material respectively in two directions which are not parallel when viewed in a normal line direction of a surface of the recording material;

an imaging device that images an area where the first light is irradiated and an area where the second light is irradiated on the surface of the recording material;

an output device that outputs information on a surface condition of the recording material based on an output of the imaging device;

an image-forming unit that forms an image on the recording material; and a control unit that sets image-forming conditions used by the image-forming unit according to an output of the output device, wherein the second light source is a light source of a type which is the same as that of the first light source, and wherein when viewed in a direction along center optical axes of the first light source and the second light source, the first light source and the second light source are arranged such that respective reference lines of rotational phases around the center optical axes are rotated in opposite directions by approximately the same angles from a line perpendicular to a direction in which the first light source and the second light source are arrayed.

9. The image-forming apparatus according to claim 8, wherein the first light source and the second light source each have an emission characteristic such that the irradiation distribution thereof is asymmetric with respect to the center optical axis when viewed in a direction perpendicular to the center optical axis.

10. The image-forming apparatus according to claim 8, wherein when viewed in a direction along the center optical axes of the first light source and the second light source, the first light source and the second light source are arranged such that the respective reference lines of the rotational phases around the center optical axes are rotated in opposite directions by approximately 90° from the line perpendicular to the direction in which the first light source and the second light source are arrayed.

11. The image-forming apparatus according to claim 10, wherein the arrangement in opposite directions is an arrangement where respective power-supplied portions of the first light source and the second light source face each other, and wherein the power-supplied portion of the first light source and the power-supplied portion of the second light source are connected to a common power supply line.

12. The image-forming apparatus according to claim 8, wherein the light guiding unit includes:

a guide portion that collects the first light and the second light; and a reflection portion that reflects the collected light so that an incident angle with respect to the recording material becomes a predetermined angle.

13. The image-forming apparatus according to claim 8, wherein the image-forming unit includes a transfer unit that transfers a developer image to the recording material, and wherein the control unit sets transfer conditions used by the transfer unit, according to the output of the output device.

14. The image-forming apparatus according to claim 8, wherein the image-forming unit includes a fixing unit that fixes a developer image, which has been formed on the recording material, on the recording material, and wherein the control unit sets fixing conditions used by the fixing unit, according to the output of the output device.

15. An image-forming apparatus, comprising:

a first light source that emits first light;

a second light source that emits second light;

a light guiding unit that allows the first light and the second light to enter a surface of a recording material respectively in two directions which are not parallel when viewed in a normal line direction of a surface of the recording material;

an imaging device that images an elongated shape imaging area irradiated with the first light and the second light, on the surface of the recording material;

an output device that outputs information on a surface condition of the recording material based on an output of the imaging device;

an image-forming unit that forms an image on the recording material; and a control unit that sets image-forming conditions used by the image-forming unit, according to an output of the output device, wherein on the surface of the recording material, an area irradiated with the first light, a light quantity of which is a predetermined value or more, and an area irradiated with the second light, a light quantity of which is a predetermined value or more, are approximately elliptical areas, respectively, and wherein the first light source and the second light source are arranged so that major axes of the elliptical areas are parallel to a longitudinal direction of the imaging area, respectively.

16. The image-forming apparatus according to claim 15, wherein the imaging device is a line sensor in which a plurality of photoelectric conversion elements are arrayed in one direction, and the longitudinal direction of the imaging area is parallel with the direction in which the plurality of photoelectric conversion elements are arrayed.

17. The image-forming apparatus according to claim 15, wherein the image-forming unit includes a transfer unit that transfers a developer image to the recording material, and wherein the control unit sets transfer conditions used by the transfer unit according to the output of the output device.

18. The image-forming apparatus according to claim 15, wherein the image-forming unit includes a fixing unit that fixes a developer image, which has been formed on the recording material, on the recording material, and wherein the control unit sets fixing conditions used by the fixing unit, according to the output of the output device.

* * * * *